US010634337B2

(12) United States Patent
Jiang

(10) Patent No.: US 10,634,337 B2
(45) Date of Patent: Apr. 28, 2020

(54) LED TUBE LAMP WITH HEAT DISSIPATION OF POWER SUPPLY IN END CAP

(71) Applicant: JIAXING SUPER LIGHTING ELECTRIC APPLIANCE CO., LTD, Zhejiang (CN)

(72) Inventor: Tao Jiang, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 15/168,962

(22) Filed: May 31, 2016

(65) Prior Publication Data

US 2016/0341414 A1 Nov. 24, 2016

Related U.S. Application Data

(63) Continuation-in-part of application No. PCT/CN2015/096502, filed on Dec. 5, 2015, and a (Continued)

(30) Foreign Application Priority Data

Dec. 5, 2014 (CN) ..... 2014 1 0734425
Feb. 12, 2015 (CN) ..... 2015 1 0075925

(Continued)

(51) Int. Cl.
*F21V 23/02* (2006.01)
*F21K 9/272* (2016.01)

(Continued)

(52) U.S. Cl.
CPC ..... *F21V 29/83* (2015.01); *F21K 9/272* (2016.08); *F21K 9/278* (2016.08); *F21V 15/015* (2013.01);

(Continued)

(58) Field of Classification Search
CPC ..... F21V 23/02; F21V 23/026; F21V 23/06; F21V 15/015; F21V 29/508; F21V 29/83;

(Continued)

(56) References Cited

U.S. PATENT DOCUMENTS 1,088,142 A 2/1914 Gardner
2,454,049 A 11/1948 Floyd, Jr.

(Continued)

FOREIGN PATENT DOCUMENTS

CN 1292930 A 4/2001
CN 2498692 Y 7/2002

(Continued)

OTHER PUBLICATIONS

Machine translation of CN 204268162 U, retrieved from espacenet on Apr. 20, 2018.*

(Continued)

*Primary Examiner* — Anh T Mai
*Assistant Examiner* — Steven Y Horikoshi
(74) *Attorney, Agent, or Firm* — Andrew M. Calderon; Roberts Calderon Safran & Cole, P.C.

(57) ABSTRACT

An LED tube lamp includes an LED lamp tube, a coupling structure, one or more end caps, one or more power supplies, and an LED light strip. The end cap is connected to an end of the LED lamp tube by the coupling structure. The power supply is in the end cap. The LED light strip including one or more LED light sources is in the LED lamp tube. The LED light sources are electrically connected to the power supply via the LED light strip. The end cap includes a tube wall and an end wall. The tube wall is coaxial with the LED lamp tube and is connected to the end of the LED lamp tube. The end wall is perpendicular to an axial direction of the tube wall and is connected to an end of the tube wall away from the LED lamp tube.

25 Claims, 22 Drawing Sheets

Related U.S. Application Data continuation-in-part of application No. 15/087,092, filed on Mar. 31, 2016, now Pat. No. 10,082,250.

(30) Foreign Application Priority Data

| | | |
|---|---|---|
| Mar. 27, 2015 | (CN) | 2015 1 0136796 |
| May 19, 2015 | (CN) | 2015 1 0259151 |
| Jun. 12, 2015 | (CN) | 2015 1 0324394 |
| Jun. 17, 2015 | (CN) | 2015 1 0338027 |
| Jun. 26, 2015 | (CN) | 2015 1 0373492 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 14, 2015 | (CN) | 2015 1 0499512 |
| Sep. 2, 2015 | (CN) | 2015 1 0555543 |
| Oct. 8, 2015 | (CN) | 2015 1 0645134 |
| Oct. 29, 2015 | (CN) | 2015 1 0716899 |
| Nov. 27, 2015 | (CN) | 2015 1 0848766 |
| Dec. 2, 2015 | (CN) | 2015 1 0868263 |
| Jan. 22, 2016 | (CN) | 2016 1 0044148 |
| Mar. 25, 2016 | (CN) | 2016 1 0177706 |
| May 18, 2016 | (CN) | 2016 1 0327806 |

(51) Int. Cl.

| | |
|---|---|
| ***F21V 29/83*** | (2015.01) |
| ***F21V 15/015*** | (2006.01) |
| ***F21V 19/00*** | (2006.01) |
| ***F21V 17/10*** | (2006.01) |
| ***F21V 17/12*** | (2006.01) |
| ***F21V 29/508*** | (2015.01) |
| ***F21V 25/04*** | (2006.01) |
| ***F21K 9/278*** | (2016.01) |
| *F21Y 103/10* | (2016.01) |
| *F21Y 115/10* | (2016.01) |

(52) U.S. Cl.

CPC ..... *F21V 17/101* (2013.01); *F21V 17/12* (2013.01); *F21V 19/009* (2013.01); *F21V 23/02* (2013.01); *F21V 25/04* (2013.01); *F21V 29/508* (2015.01); *F21Y 2103/10* (2016.08); *F21Y 2115/10* (2016.08)

(58) Field of Classification Search

CPC ..... F21K 9/272; F21K 9/275; F21K 9/278; F21K 9/235; F21K 9/237; F21K 9/27

See application file for complete search history.

(56) References Cited

U.S. PATENT DOCUMENTS

| | | | | |
|---|---|---|---|---|
| 3,294,518 | A | 12/1966 | Laseck et al. | |
| 4,059,324 | A * | 11/1977 | Snyder | H01R 13/623 439/321 |
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 5,964,518 | A * | 10/1999 | Shen | F21V 21/005 362/217.16 |
| 6,118,072 | A | 9/2000 | Scott | |
| 6,127,783 | A | 10/2000 | Pashley et al. | |
| 6,186,649 | B1 | 2/2001 | Zou et al. | |
| 6,211,262 | B1 | 4/2001 | Mejiritski et al. | |
| 6,609,813 | B1 | 8/2003 | Showers et al. | |
| 6,796,680 | B1 | 9/2004 | Showers et al. | |
| 6,860,628 | B2 | 3/2005 | Robertson et al. | |
| 6,936,855 | B1 | 8/2005 | Harrah et al. | |
| 7,033,239 | B2 | 4/2006 | Cunkelman et al. | |
| 7,067,032 | B1 | 6/2006 | Bremont et al. | |
| 7,594,738 | B1 | 9/2009 | Lin et al. | |
| 7,611,260 | B1 | 11/2009 | Lin et al. | |
| 7,815,338 | B2 | 10/2010 | Siemiet et al. | |
| 8,360,599 | B2 | 1/2013 | Ivey et al. | |
| 8,456,075 | B2 | 6/2013 | Axelsson | |
| 8,579,463 | B2 | 11/2013 | Clough | |
| 8,587,185 | B2 | 11/2013 | Negley et al. | |
| 9,322,531 | B2 | 4/2016 | Liang et al. | |
| D761,216 | S | 7/2016 | Jiang | |
| 9,447,929 | B2 | 9/2016 | Jiang | |
| 9,448,660 | B2 | 9/2016 | Seo et al. | |
| D768,891 | S | 10/2016 | Jiang et al. | |
| 9,480,109 | B2 | 10/2016 | Ye et al. | |
| 9,497,821 | B2 | 11/2016 | Liu | |
| 9,521,718 | B2 | 12/2016 | Xiong et al. | |
| 9,526,145 | B2 | 12/2016 | Xiong et al. | |
| 9,609,711 | B2 | 3/2017 | Jiang et al. | |
| 9,611,984 | B2 | 4/2017 | Jiang et al. | |
| 9,618,166 | B2 | 4/2017 | Jiang et al. | |
| 9,618,168 | B1 | 4/2017 | Jiang et al. | |
| 9,625,129 | B2 | 4/2017 | Jiang et al. | |
| 9,625,137 | B2 | 4/2017 | Li et al. | |
| 9,629,215 | B2 | 4/2017 | Xiong et al. | |
| 9,629,216 | B2 | 4/2017 | Jiang et al. | |
| D797,323 | S | 9/2017 | Yang et al. | |
| 9,835,312 | B2 | 12/2017 | Jiang et al. | |
| 9,864,438 | B2 | 1/2018 | Seo et al. | |
| 9,885,449 | B2 | 2/2018 | Jiang | |
| 9,989,200 | B2 | 6/2018 | Yingchun | |
| 10,288,272 | B2 | 5/2019 | Yao et al. | |
| 2002/0044456 | A1 | 4/2002 | Balestriero et al. | |
| 2003/0189829 | A1 | 10/2003 | Shimizu et al. | |
| 2003/0231485 | A1 | 12/2003 | Chien | |
| 2004/0095078 | A1 | 5/2004 | Leong | |
| 2004/0189218 | A1 | 9/2004 | Leong et al. | |
| 2005/0128751 | A1 | 6/2005 | Roberge et al. | |
| 2005/0162850 | A1 | 7/2005 | Luk et al. | |
| 2005/0168123 | A1 | 8/2005 | Taniwa | |
| 2005/0185396 | A1 | 8/2005 | Kutler | |
| 2005/0207166 | A1 | 9/2005 | Kan et al. | |
| 2005/0213321 | A1 | 9/2005 | Lin | |
| 2006/0028837 | A1 | 2/2006 | Mrakovich et al. | |
| 2007/0001709 | A1 | 1/2007 | Shen | |
| 2007/0145915 | A1 | 6/2007 | Roberge et al. | |
| 2007/0210687 | A1 | 9/2007 | Axelsson | |
| 2007/0274084 | A1 | 11/2007 | Kan et al. | |
| 2008/0030981 | A1 | 2/2008 | Mrakovich et al. | |
| 2008/0192476 | A1 | 8/2008 | Hiratsuka | |
| 2008/0278941 | A1 | 11/2008 | Logan et al. | |
| 2008/0290814 | A1 | 11/2008 | Leong | |
| 2008/0302476 | A1 | 12/2008 | Bommi et al. | |
| 2009/0140271 | A1 | 6/2009 | Sah | |
| 2009/0159919 | A1 | 6/2009 | Simon et al. | |
| 2009/0161359 | A1 | 6/2009 | Siemiet et al. | |
| 2010/0066230 | A1 | 3/2010 | Lin et al. | |
| 2010/0085772 | A1 | 4/2010 | Song et al. | |
| 2010/0177532 | A1 | 7/2010 | Simon et al. | |
| 2010/0201269 | A1 * | 8/2010 | Tzou | F21V 23/006 315/51 |
| 2010/0220469 | A1 | 9/2010 | Ivey et al. | |
| 2010/0253226 | A1 | 10/2010 | Oki | |
| 2010/0277918 | A1 | 11/2010 | Chen | |
| 2011/0038146 | A1 | 2/2011 | Chen | |
| 2011/0057572 | A1 | 3/2011 | Kit et al. | |
| 2011/0084554 | A1 | 4/2011 | Tian et al. | |
| 2011/0084608 | A1 | 4/2011 | Lin et al. | |
| 2011/0084627 | A1 | 4/2011 | Sloan et al. | |
| 2011/0090684 | A1 | 4/2011 | Logan et al. | |
| 2011/0149563 | A1 | 6/2011 | Hsia et al. | |
| 2011/0216538 | A1 | 9/2011 | Logan et al. | |
| 2011/0279063 | A1 | 11/2011 | Wang et al. | |
| 2011/0309745 | A1 | 12/2011 | Westermarck | |
| 2012/0049684 | A1 | 3/2012 | Bodenstein et al. | |
| 2012/0069556 | A1 | 3/2012 | Bertram et al. | |
| 2012/0106157 | A1 | 5/2012 | Simon et al. | |
| 2012/0146503 | A1 | 6/2012 | Negley et al. | |
| 2012/0153873 | A1 | 6/2012 | Hayashi et al. | |
| 2012/0169968 | A1 | 7/2012 | Ishimori et al. | |
| 2012/0212951 | A1 | 8/2012 | Lai et al. | |

(56) References Cited

U.S. PATENT DOCUMENTS

2012/0293991 A1 11/2012 Lin
2012/0319150 A1 12/2012 Shimomura
2013/0021809 A1 1/2013 Dellian et al.
2013/0033881 A1 2/2013 Terazawa et al.
2013/0033888 A1 2/2013 Van Der Wel et al.
2013/0050998 A1 2/2013 Chu et al.
2013/0069538 A1 3/2013 So
2013/0094200 A1 4/2013 Dellian et al.
2013/0135852 A1 5/2013 Chan et al.
2013/0141890 A1* 6/2013 Carlin ..... F21V 23/026 362/20
2013/0170196 A1 7/2013 Huang et al.
2013/0170245 A1 7/2013 Hong et al.
2013/0182425 A1 7/2013 Seki et al.
2013/0223053 A1 8/2013 Liu et al.
2013/0230995 A1 9/2013 Ivey et al.
2013/0250565 A1 9/2013 Chiang et al.
2013/0256704 A1 10/2013 Hsiao et al.
2013/0258650 A1 10/2013 Sharrah
2013/0293098 A1 11/2013 Li et al.
2014/0071667 A1 3/2014 Hayashi et al.
2014/0153231 A1 6/2014 Bittmann
2014/0192526 A1 7/2014 Qiu
2014/0225519 A1 8/2014 Yu
2014/0226320 A1 8/2014 Halliwell et al.
2015/0009688 A1 1/2015 Timmermans et al.
2015/0070885 A1 3/2015 Petro et al.
2015/0176770 A1 6/2015 Wilcox et al.
2015/0327368 A1 11/2015 Su
2016/0084455 A1* 3/2016 Chen ..... F21V 25/12 362/223
2016/0091147 A1 3/2016 Jiang et al.
2016/0091156 A1 3/2016 Li et al.
2016/0091179 A1 3/2016 Jiang et al.
2016/0102813 A1 4/2016 Ye et al.
2016/0178135 A1 6/2016 Xu et al.
2016/0178137 A1 6/2016 Jiang
2016/0178138 A1 6/2016 Jiang
2016/0198535 A1 7/2016 Ye et al.
2016/0215936 A1 7/2016 Jiang
2016/0215937 A1 7/2016 Jiang
2016/0223180 A1 8/2016 Jiang
2016/0223182 A1 8/2016 Jiang
2016/0229621 A1 8/2016 Jiang et al.
2016/0255699 A1 9/2016 Ye et al.
2016/0270163 A1 9/2016 Hu et al.
2016/0270164 A1 9/2016 Xiong et al.
2016/0270165 A1 9/2016 Xiong et al.
2016/0270166 A1 9/2016 Xiong et al.
2016/0270173 A1 9/2016 Xiong
2016/0270184 A1 9/2016 Xiong et al.
2016/0290566 A1 10/2016 Jiang et al.
2016/0290567 A1 10/2016 Jiang et al.
2016/0290598 A1 10/2016 Jiang
2016/0290609 A1 10/2016 Jiang et al.
2016/0295706 A1 10/2016 Jiang
2016/0309550 A1 10/2016 Xiong et al.
2016/0323948 A1 11/2016 Xiong et al.
2016/0341414 A1 11/2016 Jiang
2016/0356472 A1 12/2016 Liu et al.
2016/0363267 A1 12/2016 Jiang et al.
2016/0381746 A1 12/2016 Ye et al.
2016/0381760 A1 12/2016 Xiong et al.
2017/0001793 A1 1/2017 Jiang et al.
2017/0038012 A1 2/2017 Jiang et al.
2017/0038013 A1 2/2017 Liu et al.
2017/0038014 A1 2/2017 Jiang et al.
2017/0059096 A1 3/2017 Xu et al.
2017/0089521 A1 3/2017 Jiang
2017/0130911 A1 5/2017 Li et al.
2017/0159894 A1 6/2017 Jiang
2017/0167664 A1 6/2017 Li et al.
2017/0211753 A1 7/2017 Jiang et al.
2017/0219169 A1 8/2017 Jiang
2017/0290119 A1 10/2017 Xiong et al.
2017/0311398 A1 10/2017 Jiang et al.
2017/0318678 A1 11/2017 Miao et al.

FOREIGN PATENT DOCUMENTS

CN 1460165 A 12/2003
CN 1914458 A 2/2007
CN 2911390 Y 6/2007
CN 200980183 A 11/2007
CN 200980183 Y 11/2007
CN 101092545 A 12/2007
CN 201014273 Y 1/2008
CN 201014273 Y 1/2008
CN 101182919 A 5/2008
CN 101228393 A 7/2008
CN 201255393 Y 6/2009
CN 201363601 12/2009
CN 201437921 4/2010
CN 201437921 U 4/2010
CN 101787273 A 7/2010
CN 101806444 A 8/2010
CN 201555053 U 8/2010
CN 102016661 A 4/2011
CN 201796567 U 4/2011
CN 102052652 5/2011
CN 201866575 U 6/2011
CN 102116460 7/2011
CN 102121578 7/2011
CN 102159867 A 8/2011
CN 201954169 U 8/2011
CN 201954350 U 8/2011
CN 202120982 U 1/2012
CN 202125774 1/2012
CN 102359697 A 2/2012
CN 202132647 U 2/2012
CN 102376843 A 3/2012
CN 202216003 5/2012
CN 102518972 6/2012
CN 102518972 A 6/2012
CN 202302841 7/2012
CN 202392485 U * 8/2012
CN 102720901 10/2012
CN 102720901 U 10/2012
CN 102738355 A 10/2012
CN 102777788 11/2012
CN 102777788 A 11/2012
CN 202546288 U 11/2012
CN 102889446 1/2013
CN 102889446 A 1/2013
CN 202791824 U 3/2013
CN 103016984 A 4/2013
CN 202884614 U 4/2013
CN 103195999 A 7/2013
CN 203036285 U 7/2013
CN 203068187 7/2013
CN 203131520 U 8/2013
CN 203202766 U 9/2013
CN 203240337 10/2013
CN 203240337 U 10/2013
CN 203240362 U 10/2013
CN 203363984 12/2013
CN 203384716 U 1/2014
CN 203413396 U 1/2014
CN 203453866 U 2/2014
CN 203464014 3/2014
CN 203483210 3/2014
CN 103742875 4/2014
CN 103742875 A 4/2014
CN 203517629 U 4/2014
CN 203549435 4/2014
CN 203585876 U 5/2014
CN 203615157 5/2014
CN 203615157 U 5/2014
CN 103851547 6/2014
CN 103851547 A 6/2014
CN 103943752 A 7/2014
CN 203771102 8/2014
CN 203771102 U 8/2014

(56) References Cited

FOREIGN PATENT DOCUMENTS

| | | | |
|---|---|---|---|
| CN | 104033772 | | 9/2014 |
| CN | 203848055 | U | 9/2014 |
| CN | 203927469 | | 11/2014 |
| CN | 203927469 | U | 11/2014 |
| CN | 203963553 | U | 11/2014 |
| CN | 204042527 | | 12/2014 |
| CN | 204083927 | U | 1/2015 |
| CN | 204201535 | U | 3/2015 |
| CN | 104565931 | A | 4/2015 |
| CN | 204268162 | | 4/2015 |
| CN | 204268162 | U | 4/2015 |
| CN | 204300737 | | 4/2015 |
| CN | 104595765 | | 5/2015 |
| CN | 104633497 | | 5/2015 |
| CN | 204420636 | | 6/2015 |
| CN | 104776332 | | 7/2015 |
| CN | 104832813 | A | 8/2015 |
| CN | 204534210 | U | 8/2015 |
| CN | 204573639 | | 8/2015 |
| CN | 204573700 | U | 8/2015 |
| CN | 205447315 | U | 8/2016 |
| CN | 205877791 | U | 1/2017 |
| EP | 3146803 | | 3/2017 |
| GB | 2519258 | | 4/2015 |
| GB | 2523275 | | 8/2015 |
| GB | 2531425 | | 4/2016 |
| JP | 2008117666 | | 5/2008 |
| JP | 3147313 | U | 12/2008 |
| JP | 2011061056 | | 3/2011 |
| JP | 2012155880 | A | 8/2012 |
| JP | 2013243132 | A | 12/2013 |
| JP | 2013254667 | A | 12/2013 |
| JP | 2014103000 | A | 6/2014 |
| JP | 2014154479 | | 8/2014 |
| KR | 20120000551 | | 1/2012 |
| KR | 1020120055349 | | 5/2012 |
| WO | 2009111098 | A2 | 9/2009 |
| WO | 2011132120 | | 10/2011 |
| WO | 2012129301 | | 9/2012 |
| WO | 2013125803 | | 8/2013 |
| WO | 2014001475 | | 1/2014 |
| WO | 2014117435 | | 8/2014 |
| WO | 2014118754 | | 8/2014 |
| WO | 2015036478 | | 3/2015 |
| WO | 2015081809 | | 6/2015 |
| WO | 2016086900 | A2 | 6/2016 |
| WO | 2016086901 | | 6/2016 |

OTHER PUBLICATIONS

Machine translation of CN 202392485 U, retrieved from espacenet on Apr. 20, 2018.*

* cited by examiner

LED TUBE LAMP WITH HEAT DISSIPATION OF POWER SUPPLY IN END CAP

CROSS-REFERENCE TO RELATED APPLICATIONS

This application is a continuation-in-part application claiming benefits of U.S. application Ser. No. 15/087,092 filed on 2016 Mar. 31, and PCT Application no. PCT/CN2015/096502 filed on 2015 Dec. 5, which claims priority to Chinese Patent Applications No. CN 201410734425.5 filed on 2014 Dec. 5; CN 201510075925.7 filed on 2015 Feb. 12; CN 201510136796.8 filed on 2015 Mar. 27; CN 201510259151.3 filed on 2015 May 19; CN 201510324394.0 filed on 2015 Jun, 12; CN 201510338027.6 filed on 2015 Jun. 17; CN 201510373492.3 filed on 2015 Jun. 26; CN 201510448220.5 filed on 2015 Jul. 27; CN 201510482944.1 filed on 2015 Aug. 7; CN 201510483475.5 filed on 2015 Aug. 8; CN 201510499512.1 filed on 2015 Aug. 14; CN 201510555543.4 filed on 2015 Sep. 2; CN 201510645134.3 filed on 2015 Oct. 8; CN 201510716899.1 filed on 2015 Oct. 29, and CN 201510716899.1 filed on 2015 Dec. 02, and claiming priority of Chinese Patent Application no. CN201610327806.0 filed on 2016 May 18, and CN 201610177706.4 filed on 2016 Mar. 25, the disclosures of which are incorporated herein in their entirety by reference.

TECHNICAL FIELD

The instant disclosure relates to illumination devices, and, more particularly, to an LED tube lamp and components thereof comprising the LED light sources, a lamp tube, electronic components, and end caps.

RELATED ART

LED lighting technology is rapidly developing to replace traditional incandescent and fluorescent lightings. LED tube lamps are mercury-free in comparison with fluorescent tube lamps that need to be filled with inert air and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

Referring to Chinese patent application No. 201510056843.8, the application discloses basic structures of an LED tube lamp pertaining to a direct plug type. The LED tube lamp includes a lamp tube and end caps. The end cap includes a power supply and an end case. A light strip is inside the tube and is connected to the power supply. Referring to Chinese patent application No. 201320550914.6, the application discloses a power-adjustable end caps and a LED tube lamp. The end cap of the LED tube lamp comprises a cap body and a rotatable ring for adjusting power. Referring to U.S. Pat. No. 8,587,185, the patent discloses a linear LED lamp which includes a lamp and a transparent fluid for heat conduction within the lamp. Referring to US patent application No. US20140071667, the application discloses a linear tube lamp. The linear tube lamp includes a cylindrical case, a pair of end caps at two ends of cylindrical case, an LED substrate inside the cylindrical case, and LEDs on the LED substrate.

According to prior arts, the basic structure of the present LED tube lamps include a tube, end caps at two ends of the tube, a substrate inside the tube, LEDs on the substrate, and power supplies inside the end caps. The tube and the end caps form a sealed space. The energy conversion efficiency from electricity to radiation of traditional LED is not high; therefore a large portion of the electricity is conversed to heat energy released except for conversing to optical radiation especially for higher power LED chips which generate more heat energy. Thus, a heatsink and other related heat conduction and heat dissipation structure is needed to configured around the LED chip and substrate to improve the heat conduction from the LED chip and substrate to the outside area of the lamp tube to prevent low lighting efficiency of LED chip from overheating.

SUMMARY

Prior LED tube lamps have some issues. When the LED tube lamp operates, the electronic components of the power supply inside the end cap continuously generate heat, and the generated heat cannot be dissipated by convection of air. Instead the heat accumulates inside the end cap, which negatively affects the products' life span and reliability. According to the equation of state of a hypothetical ideal gas:

$$PV=nRT$$

Wherein the P is the pressure of the gas, V is the volume of the gas, n is the amount of substance of the gas, R is the ideal gas constant, and T is the absolute temperature of the gas. Under the circumstance that the volume and the amount of substance of the gas are fixed, the temperature is directly proportional to the pressure. In other words, the higher the temperature is, the higher the pressure is; the lower the temperature is, the lower the pressure is. Under the circumstance that the internal space of the end cap is sealed or is almost sealed (e.g., the end cap and the lamp tube are connected to each other in an adhesive manner such that there is no gap between the end cap and the lamp tube or there are extremely small gaps between the end cap and the lamp tube), the volume and the amount of substance of the gas inside the end cap are constant or proximately constant, and, consequently, the variation of the temperature causes the variation of the pressure. Sudden change of the temperature may cause sudden increase or decrease of the pressure inside the end cap. As a result, the electrical connection may be broken, e.g., the connection between a printed circuit board and a bendable circuit sheet may be detached. In addition, since continuous, high temperature of the end cap causes the increase of the pressure inside the end cap, the electronic components continuously suffering high temperature and high pressure are easily damaged. High temperature and high pressure not only negatively affect the reliability of the product, but also raise the risk of spontaneous combustion of the electronic components, which may cause fire accident.

To address the above issue, the instant disclosure provides embodiments of an LED tube lamp.

According to an embodiment, an LED tube lamp comprises an LED lamp tube, a coupling structure, at least one end cap, at least one power supply, and an LED light strip. The end cap is connected to an end of the LED lamp tube by the coupling structure. The power supply is in the end cap. The LED light strip is in the LED lamp tube. The LED light strip is provided with a plurality of LED light sources disposed thereon. The LED light sources are electrically connected to the power supply via the LED light strip. The end cap comprises a tube wall and an end wall. The tube wall is substantially coaxial with the LED lamp tube and is connected to the end of the LED lamp tube. The end wall is substantially perpendicular to an axial direction of the tube wall and is connected to an end of the tube wall away from the LED lamp tube.

According to an embodiment, the coupling structure comprises a first thread and a second thread. The first thread is disposed on the tube wall, and the second thread is disposed on the end of the LED lamp tube. The end cap is connected to the LED lamp tube by the matching of the first thread to the second thread.

According to an embodiment, the end cap further comprises at least one opening penetrating through the end wall. When the first thread fully matches the second thread, the at least one opening is rotated about the axle of the LED lamp tube to a predetermined position. When the LED tube lamp is horizontally installed to a lamp base, an altitude of the at least one opening is higher than that of the axle of the tube wall in a vertical direction.

According to an embodiment, the coupling structure further comprises a first positioning unit and a second positioning unit. The first positioning unit is disposed on the tube wall, and the second positioning unit is disposed on the end of the LED lamp tube. The first positioning unit is corresponding to the second positioning unit. When the first thread fully matches the second thread, the first positioning unit mates the second positioning unit such that the LED lamp tube and the end cap are positioned to each other.

According to an embodiment, the first positioning unit is a convex point and the second positioning unit is a concave point; or the first positioning unit is a concave point and the second positioning unit is a convex point.

According to an embodiment, torque applied to have the first thread fully match the second thread is greater than that applied to have the LED tube lamp installed to a lamp base.

According to an embodiment, the coupling structure comprises an annular convex portion and an annular trough. The annular convex portion is disposed on the tube wall, and the annular trough is disposed on the end of the LED lamp tube; or the annular convex portion is disposed on the end of the LED lamp tube, and the annular trough is disposed on the tube wall. The annular convex portion is corresponding to the annular trough. The coupling structure further comprises a first positioning unit and a second positioning unit. The first positioning unit is disposed on the tube wall, and the second positioning unit is disposed on the end of the LED lamp tube. The first positioning unit is corresponding to the second positioning unit. The end cap is connected to the LED lamp tube by the coupling of the annular convex portion and the annular trough. The first positioning unit mates the second positioning unit such that the LED lamp tube and the end cap are positioned to each other.

According to an embodiment, the end cap further comprises at least one opening penetrating through the end wall.

According to an embodiment, an axial direction of the at least one opening is substantially parallel with the axial direction of the tube wall, and the at least one opening is aligned with an inner surface of the tube wall.

According to an embodiment, an axial direction of the at least one opening and the axial direction of the tube wall define an acute angle.

According to an embodiment, the number of the end caps is two, and the two end caps are respectively connected to two opposite ends of the LED lamp tube. The number of the power supplies is two, and the two power supplies are respectively in the two end caps.

According to another embodiment, an LED tube lamp comprises an LED lamp tube, at least one end cap, at least one power supply, and an LED light strip. The end cap is connected to an end of the LED lamp tube. The power supply is in the end cap. The LED light strip is in the LED lamp tube. The LED light strip is provided with a plurality of LED light sources disposed thereon. The LED light sources are electrically connected to the power supply via the LED light strip. The end cap comprises a tube wall, an end wall, at least one opening, and two vertical ribs. The tube wall is substantially coaxial with the LED lamp tube and is connected to the end of the LED lamp tube. The end wall is substantially perpendicular to an axial direction of the tube wall and is connected to an end of the tube wall away from the LED lamp tube. The at least one opening penetrates through the end wall. The two vertical ribs are on an inner surface of the tube wall. The two vertical ribs are spaced from each other and extend along the axial direction of the tube wall. The vertical rib comprises a first side, a second side, and a third side. The first side and the second side are opposite to each other. The second side is closer to the at least one opening relative to the first side. The third side is away from the tube wall and is between the first side and the second side. The third side is connected to the power supply.

According to another embodiment, the shortest distance between the third side of the vertical rib and the tube wall gradually increases along the axial direction of the tube wall towards the end wall.

According to another embodiment, the shortest distance between the third side of the vertical rib and the tube wall gradually decreases along the axial direction of the tube wall towards the end wall.

According to another embodiment, a projection of the two vertical ribs is inside a projection of the at least one opening on a plane of projection perpendicular to the axial direction of the tube wall.

According to another embodiment, the end cap further comprises two horizontal ribs. The two horizontal ribs are on the inner surface of the tube wall. The two horizontal ribs are spaced from each other and extend along the axial direction of the tube wall. The two horizontal ribs are respectively corresponding to the two vertical ribs. The power supply is between the vertical ribs and the horizontal ribs.

According to another embodiment, the horizontal rib comprises a first rib portion, a second rib portion, and a cut portion. The cut portion is between the first rib portion and the second rib portion. The first rib portion and the second rib portion are spaced from each other by the cut portion.

According to another embodiment, the horizontal rib comprises at least one ventilating hole.

According to another embodiment, the end cap further comprises a blocking plate. The blocking plate is on the inner surface of the tube wall. The blocking plate and the end wall are spaced from each other in the axial direction of the tube wall. A side of the power supply facing towards the end wall contacts the blocking plate.

According to another embodiment, the LED light strip locates at a first plane, and the power supply locates at a second plane. The first plane and the second plane are parallel with the axial direction of the tube wall. The first plane and the second plane define an angle about the axial direction of the tube wall. The angle is greater than 0 degree and is less than 90 degrees.

According to the embodiments of the LED tube lamp of the instant disclosure, when the LED tube lamp operates, the heat generated by the electronic components of the power supply inside the end cap can be efficiently dissipated through the at least one opening. Therefore, a heatsink or other heat dissipating means is not needed to be configured inside the lamp tube as long as at least one opening is configured on the end cap then the heat dissipating effect needed can be achieved. Thus the heat won't accumulate inside the end cap. The at least one opening can also function as a pressure-relieving tunnel. If the air inside the end cap expands, the expanding air can be released through the at least one opening such that the pressure inside the end cap won't vary with the temperature. As a result, the products' life span can be longer and the product can have better reliability.

BRIEF DESCRIPTION OF THE DRAWINGS

FIG. 22-1 illustrates a three dimensional, cross sectional view of an end cap of an LED tube lamp according to an embodiment of the instant disclosure;

DETAILED DESCRIPTION

Figure 1:
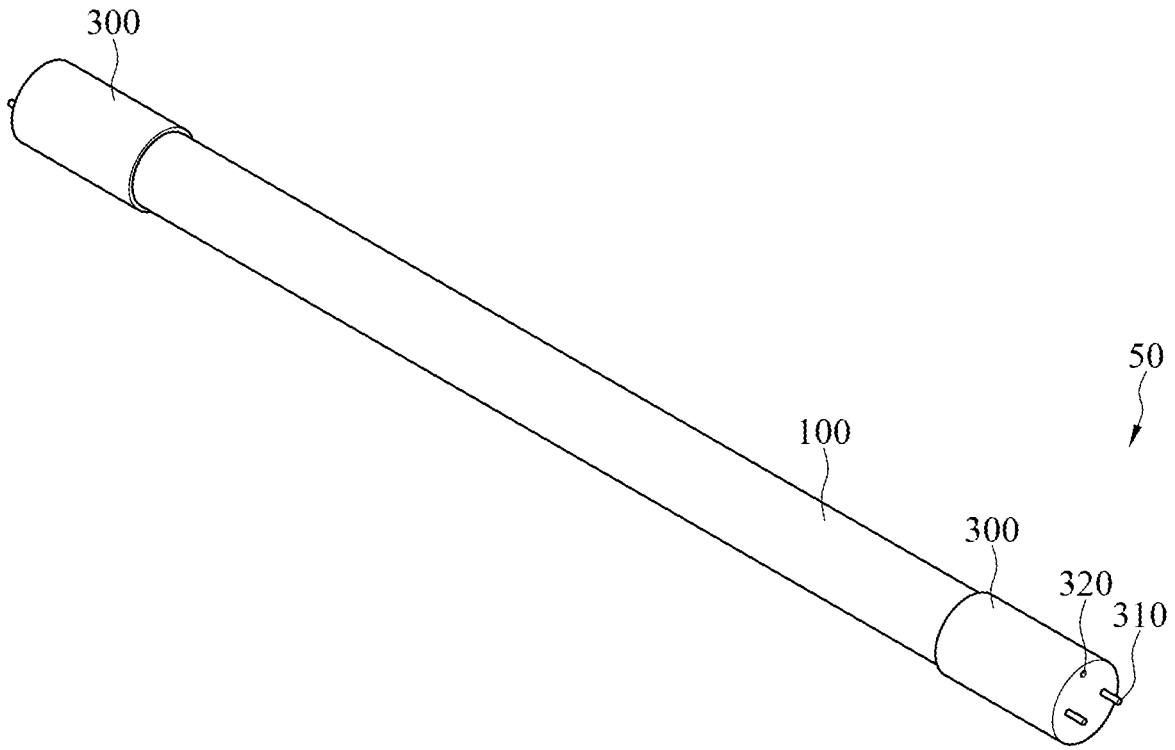
FIG. 1 illustrates a perspective view of an LED tube lamp according to an embodiment of the instant disclosure.

The instant disclosure provides an LED tube lamp to solve the abovementioned problems. The instant disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, part or section. Thus, a first element, component, region, part or section discussed below could be termed a second element, component, region, part or section without departing from the teachings of the present disclosure.

The following description with reference to the accompanying drawings is provided to explain the exemplary embodiments of the disclosure. Note that in the case of no conflict, the embodiments of the present disclosure and the features of the embodiments may be arbitrarily combined with each other.

As indicated in the section of the cross-reference, the instant disclosure claims priority of several Chinese patent applications, and the disclosures of which are incorporated herein in their entirety by reference. When it comes to claim construction, the claims, specification, and prosecution history of the instant disclosure controls if any inconsistency between the instant disclosure and the incorporated disclosures exists.

Figure 2:
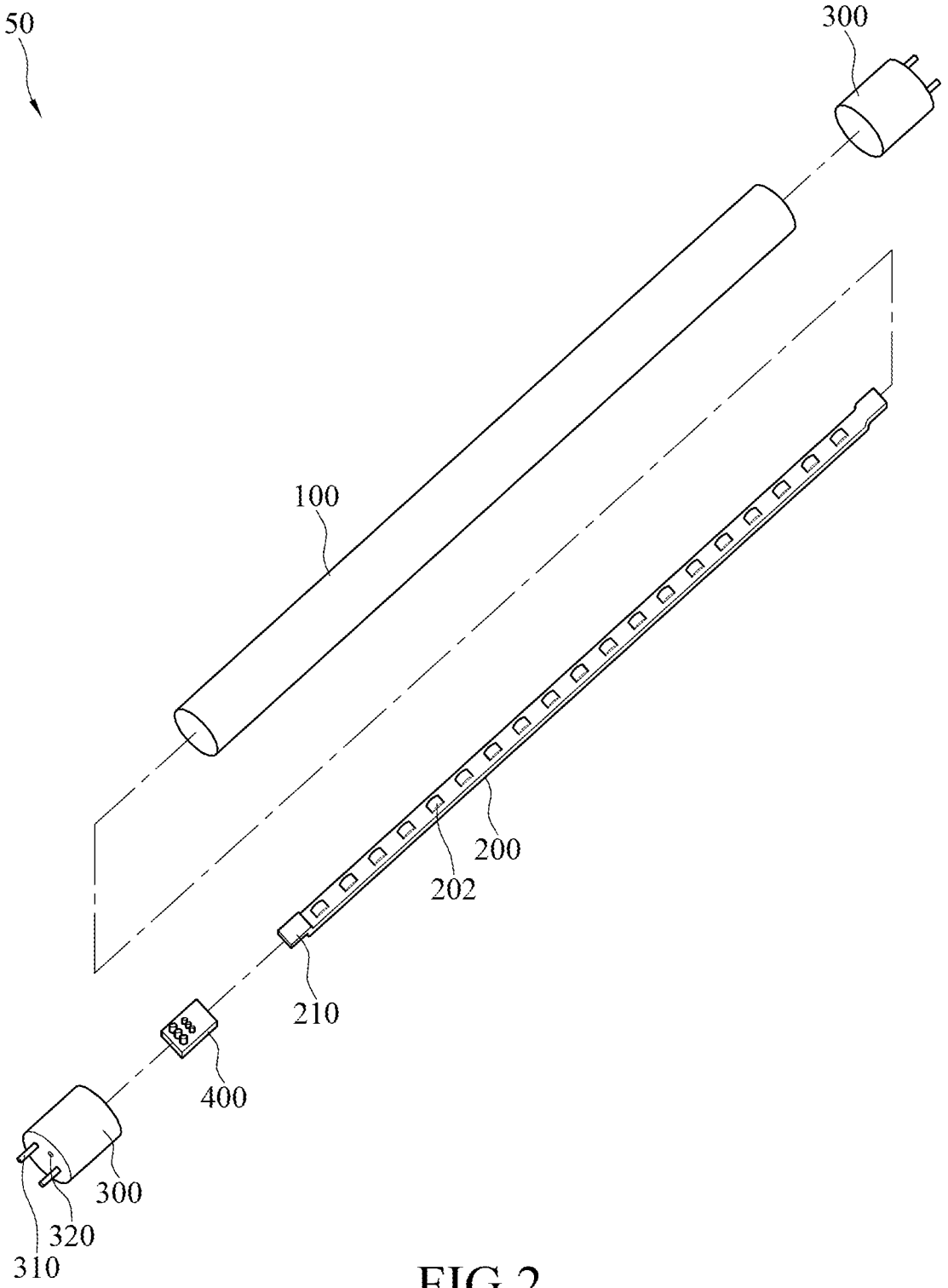
FIG. 2 illustrates an exploded view of an LED tube lamp according to an embodiment of the instant disclosure.

Referring to FIG. 1 and FIG. 2, the instant disclosure provides an embodiment of an LED tube lamp 50 which comprises an LED lamp tube 100, an LED light strip 200, and end caps 300. The LED light strip 200 is disposed inside the LED lamp tube 100. Two end caps 300 are respectively disposed on two ends of the LED lamp tube 100. The LED tube lamp 100 can be a plastic lamp tube, a glass lamp tube, a plastic-metal combined lamp tube, or a glass-metal combined lamp tube. The two end caps 300 can have the same size or have different sizes. Referring to FIG. 2, several LED light sources 202 are disposed on the LED light strip 200, and a power supply 400 is disposed in the end cap 300. The LED light sources 202 and the power supply 400 can be electrically connected to each other via the LED light strip 200. The LED light strip 200 can be a bendable circuit sheet. Middle part of the LED light strip 200 can be mounted on the inner surface of the LED lamp tube 100. Instead, two opposite, short edges of the LED light strip 200 are not mounted on the inner surface of the LED lamp tube 100. The LED light strip 200 comprises two freely extending end portions 210. The two freely extending end portions 210 are respectively disposed on the two opposite, short edges of the LED light strip 200. The two freely extending end portions 210 respectively extend outside the LED lamp tube 100 through two holes at two opposite ends of the LED lamp tube 100 along the axial direction of the LED lamp tube 100. The two freely extending end portions 210 can respectively extend to inside the end caps 300 and can be electrically connected to the power supplies 400. Each of the end caps 300 comprises a pair of hollow conductive pins 310 utilized for being connected to an outer electrical power source. When the LED tube lamp 50 is installed to a lamp base, the hollow conductive pins 310 are plugged into corresponding conductive sockets of the lamp base such that the LED tube lamp 50 can be electrically connected to the lamp base.

As shown in FIG. 2, the LED lamp tube 100 comprises two ends opposite to each other. Each of the two ends of the LED lamp tube 100 forms a hole. The LED lamp tube 100 is a linear tube, i.e., the bore of LED lamp tube 100 is identical from one end (one of the two holes formed by the two ends of the LED lamp tube 100) to the other end (the other one of the two holes formed by the two ends of the LED lamp tube 100). As shown in FIG. 1, the appearance of the LED tube lamp 50 is not identical, meaning that the diameter of the end cap 300 is radially larger than that of the LED lamp tube 100.

Figure 3:
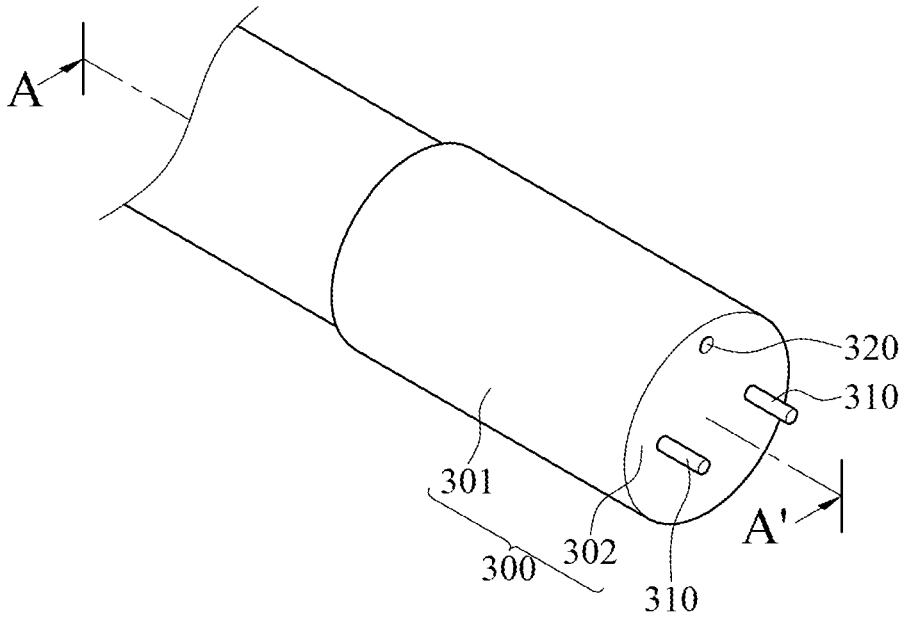
FIG. 3 illustrates a partial view of an LED tube lamp according to an embodiment of the instant disclosure.
Figure 4:
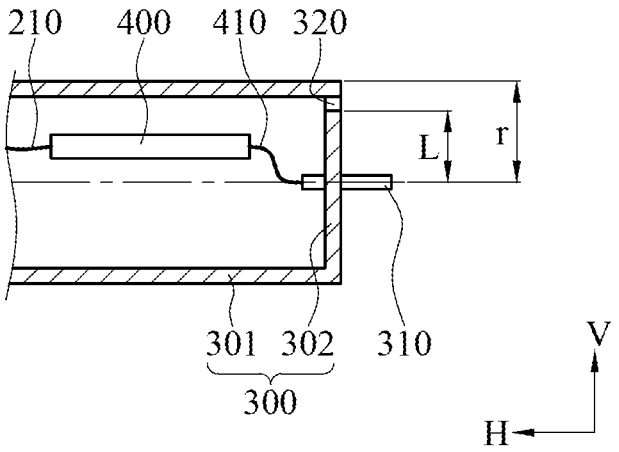
FIG. 4 illustrates a part of a cross section of FIG. 3 along the line A-A'.

Referring to FIG. 3 and FIG. 4, FIG. 3 is a partial view of the LED tube lamp 50, and FIG. 4 is a cross section of FIG. 3 along the line A-A'. The end cap 300 of the embodiment further comprises a tube wall 301, an end wall 302, and an opening 320. The tube wall 301 and the LED lamp tube 100 are coaxial and are connected to each other. More specifically, the tube wall 301 and the LED lamp tube 100 are substantially coaxial but the alignment of the axial directions of the tube wall 301 and the LED lamp tube 100 may have a slightly shift due to manufacturing tolerance. The end wall 302 is perpendicular to the axial direction of the tube wall 301. The end wall 302 is connected to an end of the tube wall 301 away from the LED lamp tube 100. More specifically, the end wall 302 is substantially perpendicular to the axial direction of the tube wall 301 but the angle between the end wall 302 and the axial direction of the tube wall 301 may not be exactly 90 degrees due to manufacturing tolerance. Even if the end wall 302 relative to the axial direction of the tube wall 301 is slightly inclined, the end wall 302 and the tube wall 301 can still form a receiving space for receiving the power supply 400 and can mate the lamp base. The end wall 302 and the tube wall 301 form an inner space of the end cap 300. The power supply 400 is disposed in the inner space of the end cap 300. The opening 320 penetrates through the end wall 302. The inner space of the end cap 300 can communicate with outside area through the opening 320. Air can flow through the opening 320 between the inner space of the end cap 300 and outside area.

The power supply 400 can be a module, e.g., an integrated power module. The power supply 400 further comprises a pair of metal wires 410. The metal wires 410 extend from the power supply 400 to the inside of the hollow conductive pins 310 and are connected to the hollow conductive pins 310. In other words, the power supply 400 can be electrically connected to the outer electrical power source through the metal wires 410 and the hollow conductive pins 310. The hollow conductive pins 310 are disposed outside the end wall 302 and extend along the axial direction of the tube wall 301. Referring to FIG. 4, when the LED tube lamp 50 is installed to a horizontal lamp base (not shown), the axle of the tube wall 301 is parallel with the horizontal direction "H", and the pair of the hollow conductive pins 310 are at the same altitude and overlap each other in the vertical direction "V". Under the circumstance, the altitude of the opening 320 is higher than that of the axle of the tube wall 301 in the vertical direction "V".

In the embodiment, as shown in FIG. 4, the axial direction of the opening 320 is substantially parallel with that of the tube wall 301. The axial direction of the opening 320 is defined as an extending direction of the opening 320 extending from the inner surface of the end wall 302 (the surface inside the end cap 300) to the outer surface of the end wall 302 (the surface outside). In the embodiment, the opening 320 is aligned with the inner surface of the tube wall 301 (the surface inside the end cap 300). Specifically, a part of the inner surface of the opening 320 is aligned with a part of the inner surface of the tube wall 301.

In the embodiment, as shown in FIG. 4, an end wall radius "r" is defined as the shortest distance between the center of the end wall 302 (the point of the end wall 302 through which the axle of the tube wall 301 passes) and the periphery of the end wall 302 in the radial direction of the end cap 300 (the direction parallel with the vertical direction "V" shown in FIG. 4). A distance "L" is defined as the shortest distance between the center of the end wall 302 and the opening 320 in the radial direction of the end cap 300. The distance "L" is from ⅖ to ⅘ of the end wall radius "r". That is to say, the relation of the opening 320 and the end wall 302 matches an equation listed below:

$$0.4r \leq L \leq 0.8r$$

When the position of the opening 320 relative to the center of the end wall 302 matches the aforementioned equation, the convection of air between the LED tube lamp 50 and outside area can be more efficiently.

Figure 5:
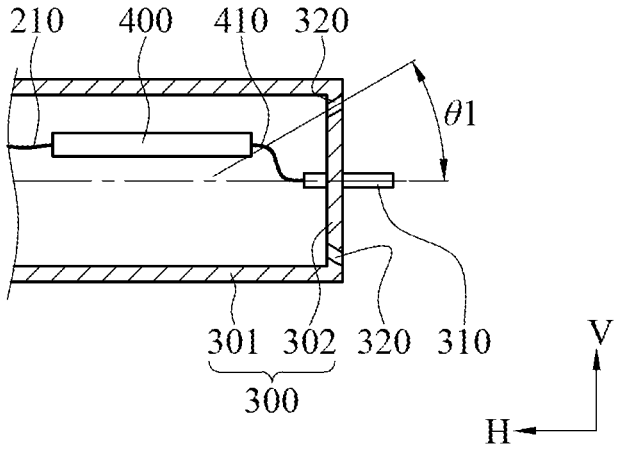
FIG. 5 illustrates a part of a cross section of an LED tube lamp according to an embodiment of the instant disclosure.

Referring to FIG. 5, the difference between the LED tube lamps 50 of FIG. 5 and FIG. 4 is the forms of the openings 320. In the embodiment, as shown in FIG. 5, the opening 320 can be inclined. The axial direction of the opening 320 and the axial direction of the tube wall 301 define an angle θ1. The angle θ1 is an acute angle. The axial direction of the opening 320 is defined as an extending direction of the opening 320 extending from the inner surface of the end wall 302 to the outer surface of the end wall 302. When the LED tube lamp 50 is installed to the horizontal lamp base, the axial directions of the LED lamp tube 100 and the end cap 300 are parallel with the horizontal direction "H", and the altitude of the opening 320 is higher than that of the axle of the LED lamp tube 100 and the end cap 300 in the vertical direction "V". When the power supply 400 generates heat in operation, the inclined opening 320 shown in FIG. 5 is beneficial to the process that heated air rises (along the vertical direction "V") and flows to outside area through the opening 320.

Additionally, two openings 320 are acceptable. As shown in FIG. 5, two inclined openings 320 are symmetrical to each other. When the LED tube lamp 50 is installed to the horizontal lamp base, the axial directions of the LED lamp tube 100 and the end cap 300 are parallel with the horizontal direction "H", and the altitude of one of the two openings 320 is higher than that of the axle of the LED lamp tube 100 and the end cap 300 in the vertical direction "V" while the other one of the two openings 320 is lower than that of the axle of the LED lamp tube 100 and the end cap 300 in the vertical direction "V". Each of the axial directions of the two openings 320 and the axial direction of the tube wall 301 respectively define an acute angle. When the power supply 400 generates heat in operation, the upper opening 320 shown in FIG. 5 is beneficial to the process that heated air rises (along the vertical direction "V") and flows to outside area through the upper opening 320, and the lower opening 320 shown in FIG. 5 is beneficial to the process that cool air from outside area flow to inside of the end cap 300 through the lower opening 320. As a result, convection of the heated air and cool air is improved, and, consequently, the effect of heat dissipation is better.

Figure 6:
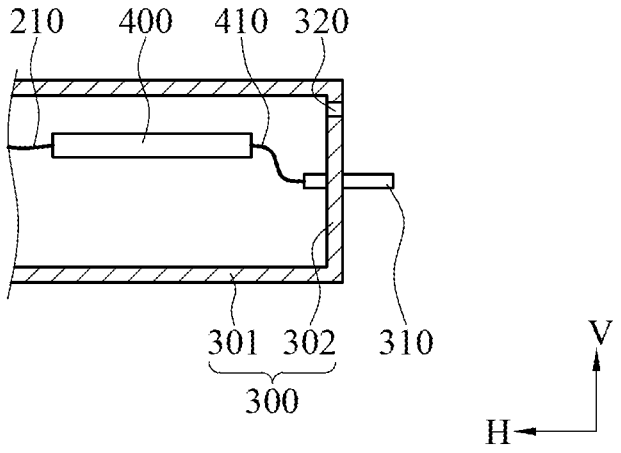
FIG. 6 illustrates a part of a cross section of an LED tube lamp according to an embodiment of the instant disclosure.

Referring to FIG. 6, the difference between the LED tube lamps 50 of FIG. 6 and FIG. 4 is the forms of the openings 320. As shown in FIG. 6, the opening 320 is not aligned with the inner surface of the tube wall 301. Comparing to the opening 320 of FIG. 4, the opening 320 of FIG. 6 is away from the end wall 302.

If the opening 320 is too large, dust from outside area may easily pass through the opening 320 and enter the inner space of the end cap 300. Dust may accumulate on the power supply 400 and negatively affect the effect of heat dissipation. To prevent dust from passing through the opening 320, the radial area of the opening 320 is preferably less than 1/10 of the radial area of the end wall 302. Under the circumstance, dust is hard to pass through the opening 320 to enter the inner space of the end cap 300. In an example that the LED tube lamp 50 is a T8 tube lamp of which the external diameter of the LED lamp tube 100 is 25 mm to 28 mm, and the external diameter of the end cap 300 (i.e., the diameter of the end wall 302 in the vertical direction "V" shown in FIG. 4) is greater than that of the LED lamp tube 100. If the diameter of the end wall 302 in the vertical direction "V" shown in FIG. 4 is 25 mm, the area of the end wall 302 in the vertical direction "V" is 490.625 $mm^2$ (square of the radius of the end wall 302 times 3.14), and the bore area (the radial area) of the opening 320 in the vertical direction "V" is 0.5 $mm^2$ to 6 $mm^2$. For example, the radial area of the opening 320 is 6 $mm^2$ and the radial area of the end wall 302 is 490.625 $mm^2$, the radial area of the opening 320 is about 1/100 of the radial area of the end wall 302. Under the circumstance, dust is hard to pass through the opening 320 to enter the inner space of the end cap 300. In different embodiments, the bore area (the radial area) of the opening 320 in the vertical direction "V" is 0.5 $mm^2$ to 3 $mm^2$. Under the circumstance, dust is much harder to pass through the opening 320 to enter the inner space of the end cap 300.

In different embodiments, the end cap 300 further comprises a dust-proof net (not shown). The dust-proof net is a net with fine meshes. The dust-proof net can cover the opening 320. For example, the dust-proof net can be mounted on the outer surface or the inner surface of the end wall 302 and cover the opening 320. As a result, the dust-proof net can prevent dust from entering the opening 320 and keep ventilation well.

Figure 7:
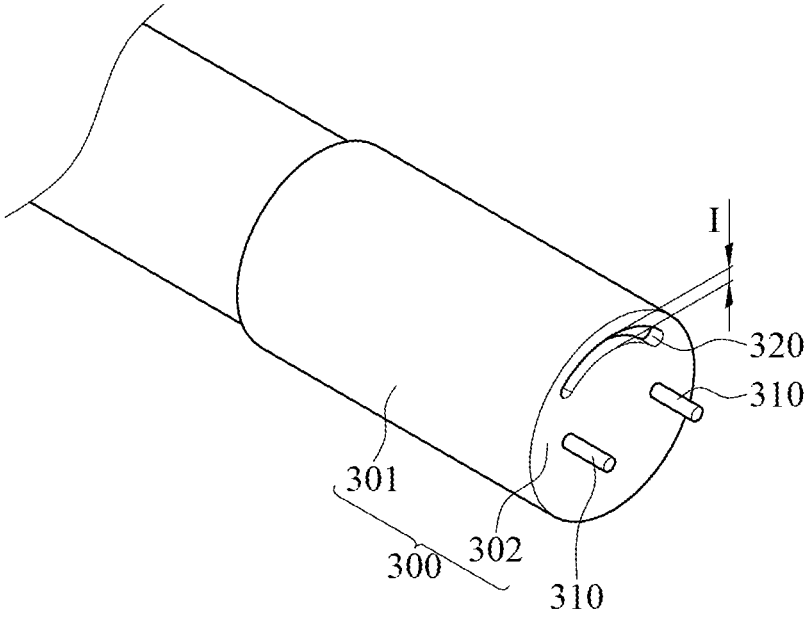
FIGS. 7 to 14 illustrate partial views of LED tube lamps according to several embodiments of the instant disclosure.

Referring to FIG. 7, the difference between the end caps 300 of FIG. 7 and FIG. 3 is the forms of the openings 320. The opening 320 shown in FIG. 3 is a circular opening. In the embodiment, the opening 320 shown in FIG. 7 is an arc-shaped opening which is long and flat. The opening 320 shown in FIG. 7 includes two opposite long edges (arc edges) and two opposite short edges between the two long edges. The opening 320 has an interval "I" which is the shortest distance between the two long edges. Under the circumstance, the interval "I" of the opening 320 is much shorter than the length (or width) of the long edge. Even if the interval "I" of the opening 320 is equal to or slightly less than the diameter (i.e., the bore) of the opening 320 shown in FIG. 3, the bore area of the opening 320 shown in FIG. 7 is still greater than that of the opening 320 shown in FIG. 3. As a result, the opening 320 of FIG. 7 can not only prevent dust from passing through but also keep ventilation well.

In different embodiments, the number, the shape, the position, or the arrangement of the opening(s) 320 can be varied according to different design. Details are described below.

Figure 8:
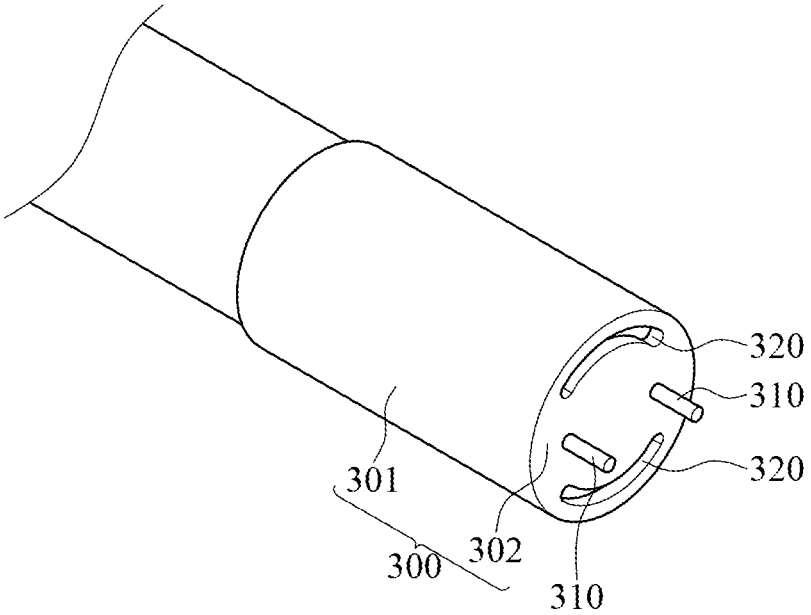

Referring to FIG. 8, the difference between the end caps 300 of FIG. 8 and FIG. 7 is the amount and forms of the openings 320. In the embodiment, there are two openings 320 shown in FIG. 8, and the two openings 320 are symmetrical to each other. The two symmetrical openings 320 shown in FIG. 8 are beneficial to convection of heated air and cool air. The better the convection is, the better the effect of heat dissipation is.

Figure 9:
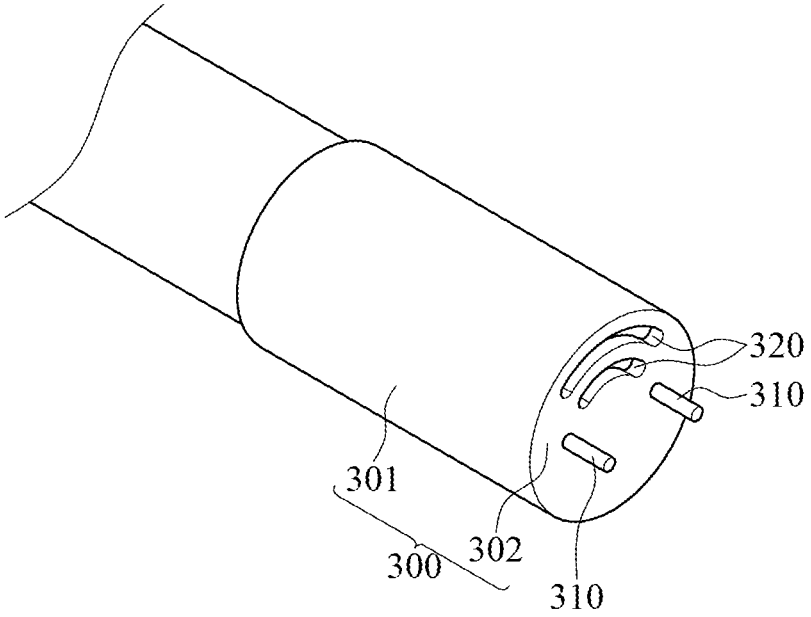

Referring to FIG. 9, the difference between the end caps 300 of FIG. 9 and FIG. 7 is the amount and forms of the openings 320. In the embodiment, there are two openings 320 shown in FIG. 9, and the two openings 320 are adjacent to each other. Under the circumstance that the interval between the two long edges of either opening 320 shown in FIG. 9 is equal to that of the opening 320 shown in FIG. 7, the sum of the bore areas of the two adjacent openings 320 shown in FIG. 9 is greater than the bore area of the single opening 320 shown in FIG. 7. The two adjacent openings 320 shown in FIG. 9 are not only beneficial to convection but also beneficial to prevent dust from passing through the opening 320 and entering the end cap 300.

Figure 10:
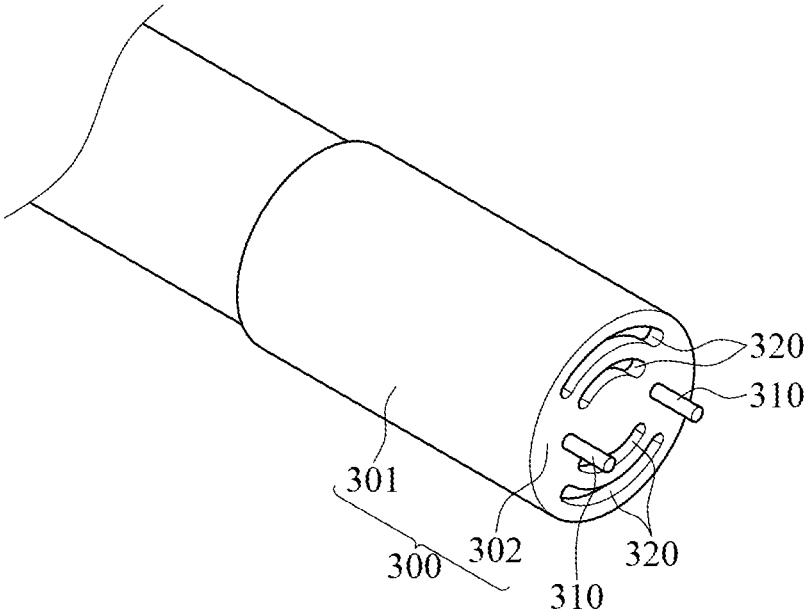

Referring to FIG. 10, the difference between the end caps 300 of FIG. 10 and FIG. 9 is the amount and forms of the openings 320. In the embodiment, there are two set of two openings 320 shown in FIG. 10, and the two set of two openings 320 are symmetrical to each other. The two set of two openings 320 shown in FIG. 10 are not only beneficial to convection of heated air and cool air but also beneficial to prevent dust from passing through the opening 320 and entering the end cap 300.

Figure 11:
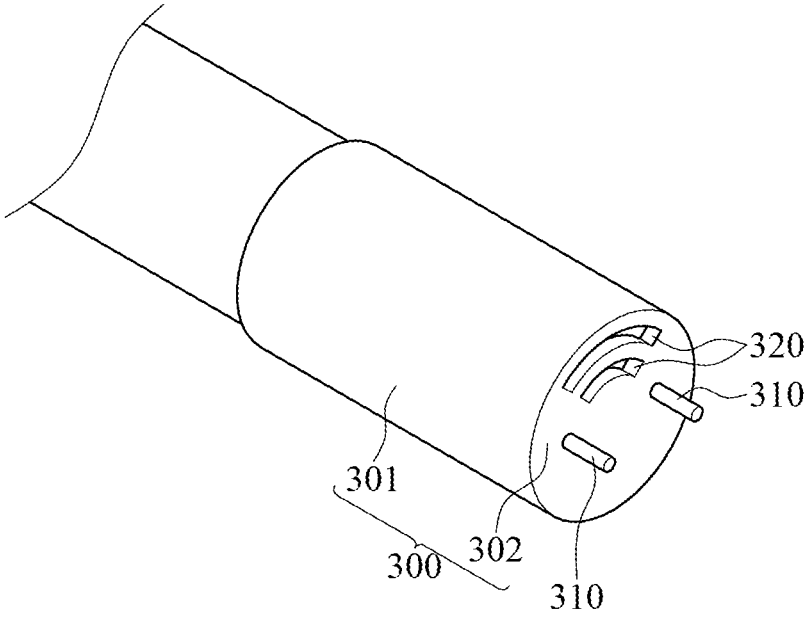
Figure 12:
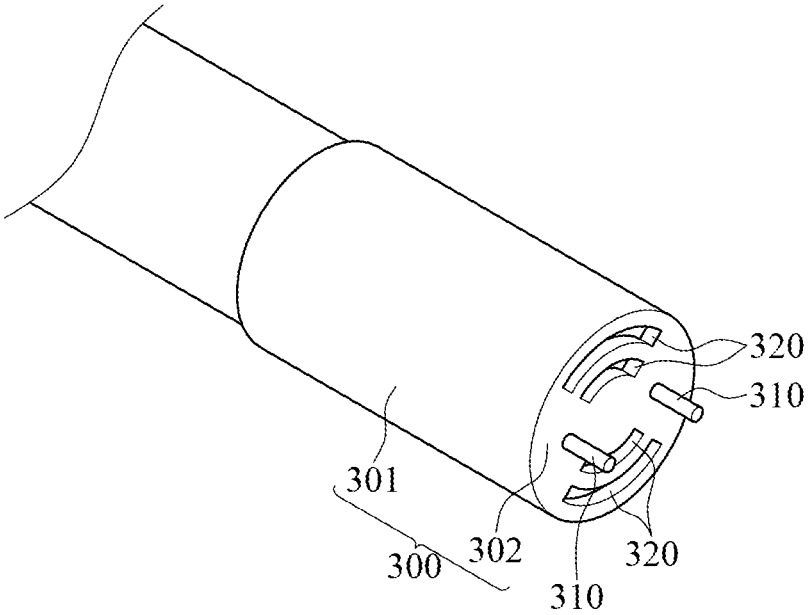

Referring to FIG. 11, the difference between the end caps 300 of FIG. 11 and FIG. 9 is the forms of the openings 320. The two short edges opposite to each other of each opening 320 shown in FIG. 9 are round. In the embodiment, the two short edges opposite to each other of each opening 320 shown in FIG. 11 are rectangular. Referring to FIG. 12, the difference between the end caps 300 of FIG. 12 and FIG. 10 is the forms of the openings 320. The two short edges opposite to each other of each opening 320 shown in FIG. 10 are round. In the embodiment, the two short edges opposite to each other of each opening 320 shown in FIG.

12 are rectangular. In different embodiments, the opening 320 can be a long, narrow and straight shaped opening.

Figure 13:
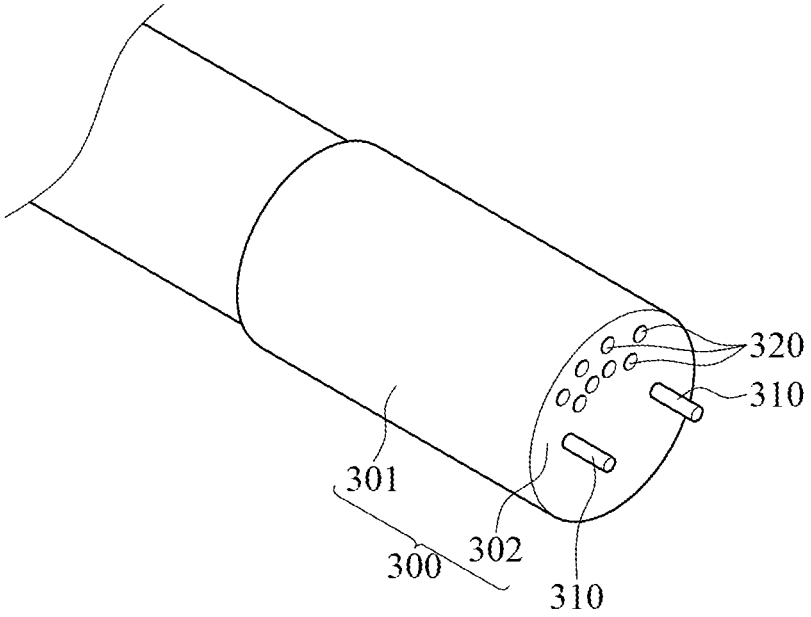

Referring to FIG. 13, the difference between the end caps 300 of FIG. 13 and FIG. 3 is the amount and forms of the openings 320. In the embodiment, the end cap 300 shown in FIG. 13 comprises several openings 320. The openings 320 have a circular shaped opening and are asymmetrically arranged on the end wall 302. Referring to FIG. 3 and FIG. 13, when the LED tube lamp 50 is installed to the horizontal lamp base, the axial directions of the LED lamp tube 100 and the end cap 300 are parallel with the horizontal direction "H", and the altitude of at least one of the openings 320 shown in FIG. 13 is higher than that of the axle of the LED lamp tube 100 and the end cap 300 in the vertical direction "V". In the embodiment, the altitudes of all of the openings 320 shown in FIG. 13 are higher than that of the axle of the LED lamp tube 100 and the end cap 300 in the vertical direction "V". In different embodiments, the openings 320 symmetrically arranged on the end wall 302 have different shapes, e.g., a long, circular shape. Moreover, at least a part of at least one of the openings 320 is higher than the axle of the LED lamp tube 100 and the end cap 300 in the vertical direction "V".

Figure 14:
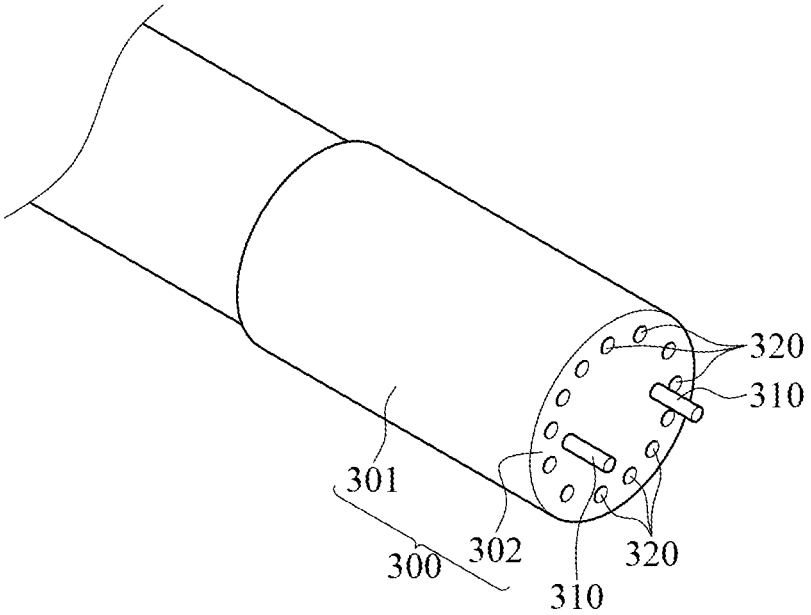

Referring to FIG. 14, the difference between the end caps 300 of FIG. 14 and FIG. 13 is the amount, arrangement and forms of the openings 320. In the embodiment, the end cap 300 shown in FIG. 14 comprises several openings 320, and the openings 320 relative to the axle of the end cap 300 are symmetrical. The openings 320 are arranged on the end wall 302 and are around the axle of the end cap 300 in point symmetry.

Figure 15:
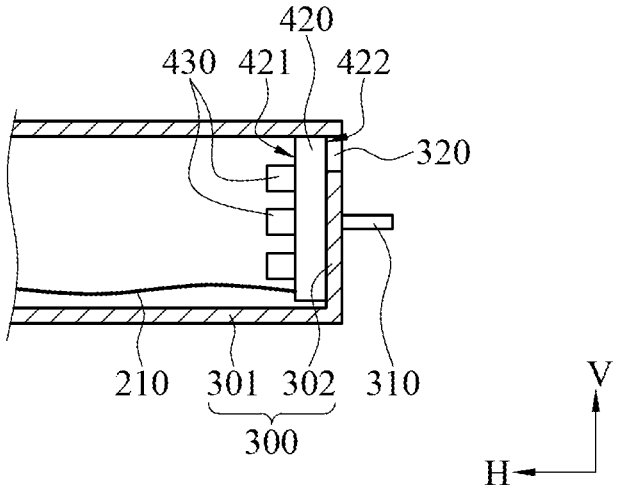
FIGS. 15 to 18 illustrate a part of cross sections of LED tube lamps according to several embodiments of the instant disclosure.

Referring to FIG. 15, the differences between the LED tube lamps 50 of FIG. 15 and FIG. 4 are the forms of the power supplies 400 and the opening 320. The power supply 400 shown in FIG. 15 comprises a printed circuit board 420 and one or more power supply components 430. The printed circuit board 420 comprises a first surface 421 and a second surface 422 opposite to and parallel with each other. The first surface 421 and the second surface 422 of the printed circuit board 420 are perpendicular to the axial direction of the tube wall 301. The second surface 422 of the printed circuit board 420 relative to the first surface 421 is closer to the end wall 302. The power supply components 430 are disposed on the first surface 421 of the printed circuit board 420.

In the embodiment, as shown in FIG. 15, the second surface 422 of the printed circuit board 420 contacts the inner surface of the end wall 302. Moreover, the metal wires 410 (not shown in FIG. 15) of the power supply 400 can be directly inserted in the hollow conductive pins 310 from the printed circuit board 420. Alternatively, the hollow conductive pins 310 can be directly contacted by a pair of corresponding contacts (not shown) on the second surface 422 of the printed circuit board 420. In addition, the freely extending end portion 210 is connected to the first surface 421 of the printed circuit board 420. In different embodiments, the second surface 422 of the printed circuit board 420 does not contact the inner surface of the end wall 302 and instead, the second surface 422 of the printed circuit board 420 is spaced from the inner surface of the end wall 302 by a predetermined interval. The interval between the printed circuit board 420 and the end wall 302 is beneficial to convection of air.

In the embodiment, as shown in FIG. 15, the second surface 422 of the printed circuit board 420 fully contacts the inner surface of the end wall 302 and covers the opening 320; therefore, heat generated by the printed circuit board 420 can be directly transferred to cool air outside the end cap 300 through the opening 320 and, consequently, the effect of heat dissipation is well. Furthermore, under the circumstance that the second surface 422 of the printed circuit board 420 fully covers the opening 320, dust is blocked by the printed circuit board 420 so that dust won't pass through the opening 320 to enter the inner space of the end cap 300. Thus, the bore area of the opening 320 shown in FIG. 15 can be greater than that of the opening 320 shown in FIG. 4.

In different embodiments, the second surface 422 of the printed circuit board 420 contacts the inner surface of the end wall 302 while the end cap 300 has no opening 320. In the situation, the end wall 302 can comprise a material with high thermal conductivity. The end wall 302, for example, can be made by composite materials. The part of the end wall 320 which is connected to the hollow conductive pins 310 is made by an insulating material, and the other part of the end wall 320 is made by aluminum. Heat generated by the printed circuit board 420 can be directly transferred to the part of aluminum of the end wall 302 and then can be transferred to cool air outside the end cap 300 through the part of Aluminum; therefore, the effect of heat dissipation is well. In different embodiments, the opening 320 can be disposed on the tube wall 301 such that when the LED tube lamp 50 is installed to the horizontal lamp base, the altitude of the opening 320 on the tube wall 301 is higher than that of the axle of the LED lamp tube 100 and the end cap 300 in the vertical direction "V".

Figure 16:
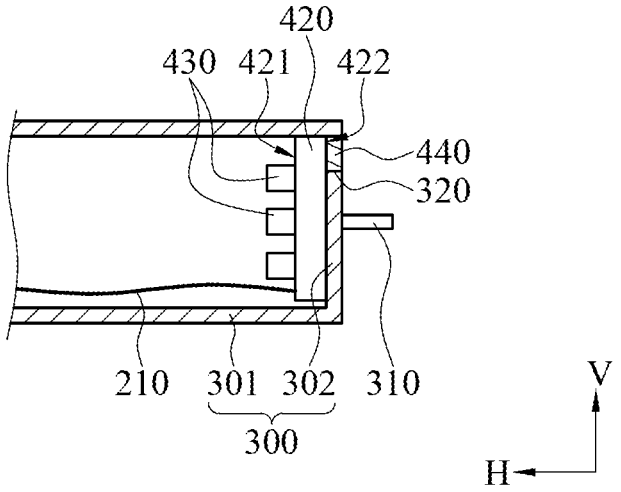

Referring to FIG. 16, the difference between the LED tube lamps 50 of FIG. 16 and FIG. 15 is that the power supply 400 shown in FIG. 16 further comprises a particular component 440. The particular component 440 is disposed on the second surface 422 of the printed circuit board 420 and extends into the opening 320. In an embodiment, the particular component 440 is a heat-dissipating element, e.g., a metal heat pipe or a metal fin. Heat generated by the power supply components 430 on the printed circuit board 420 can be transferred to the heat-dissipating element and then can be transferred to cool air outside the end cap 300 through the heat-dissipating element; therefore, the effect of heat dissipation is well. In an embodiment, the particular component 440 is a driving module. Since the driving module is a mainly heat source among the electronic components of the power supply 400, the idea of separation of the general power supply components 430 (the electronic components generating less heat than the driving module) and the driving module is beneficial to improve the effect of heat dissipation. For example, the power supply components 430 are disposed on the first surface 421 of the printed circuit board 420 and the particular component 440 generating significant heat is disposed on the second surface 422 of the printed circuit board 420. The particular component 440 can be disposed in the opening 320 such that the heat generated by the particular component 440 can be directly transferred to cool air outside the end cap 300; therefore, the effect of heat dissipation is well. The driving module comprises one or more electronic components generating significant heat including an inductor, a transistor, or an integrated circuit. The arrangement of having the inductor, the transistor, or the integrated circuit positioned in the opening 320 is beneficial to improve the effect of heat dissipation.

In different embodiments, several particular components 440 of the power supply 400 can be respectively disposed in several openings 320. For example, the inductor, the transistor, and the integrated circuit can be respectively disposed in different openings 320. Alternatively, the heat-dissipating element, the inductor, the transistor, and the integrated circuit can be respectively disposed in different openings 320.

Figure 17:
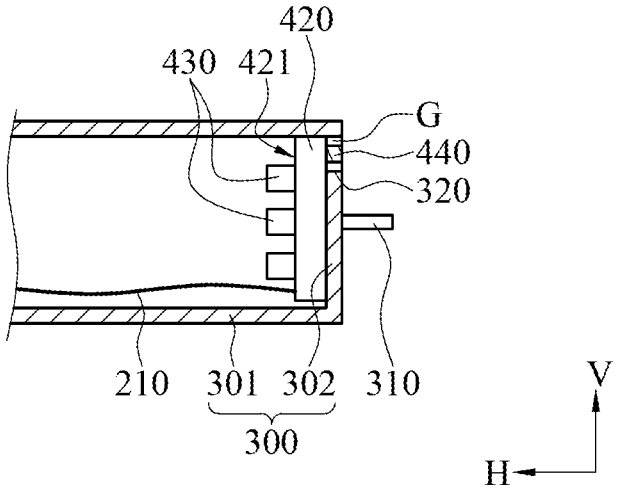

Referring to FIG. 16 and FIG. 17, the difference between FIG. 16 and FIG. 17 is whether the particular component 440 and the opening 320 are closed in the radial direction of the opening 320. The particular component 440 and the opening 320 shown in FIG. 16 are closed, which means that the shape and the size of the cross section of the particular component 440 in the radial direction exactly match the shape and the size of the bore of the opening 320 in the radial direction. Instead, there is a gap "G" between the particular component 440 and the opening 320 in the radial direction shown in FIG. 17. Thus the outside air can freely flow through the gap "G" to enter the end cap 300 while the particular component 440 is in the opening 320. The effect that the particular component 440 and the opening 320 are closed in the radial direction is not the same as the effect of air tight. There may be small gaps hard to be seen by eyes but still exist between the particular component 440 and the opening 320 shown in FIG. 16. However, the small gaps between the particular component 440 and the opening 320 shown in FIG. 16 is much smaller than the gap "G" shown in FIG. 17 and, consequently, the particular component 440 and the opening 320 shown in FIG. 16 block cool air outside the opening 320 to a great extent.

Figure 18:
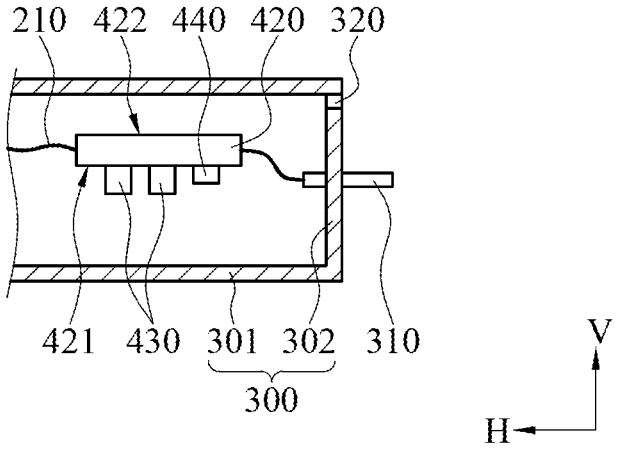

Referring to FIG. 18, the differences between the LED tube lamps 50 of FIG. 18 and FIG. 4 are the forms of the power supplies 400. The power supply 400 shown in FIG. 18 comprises a printed circuit board 420, one or more power supply components 430, and a particular component 440. The printed circuit board 420 comprises a first surface 421 and a second surface 422 opposite to and parallel with each other. The first surface 421 and the second surface 422 of the printed circuit board 420 are parallel with the axial direction of the tube wall 301. The power supply components 430 and the particular component 440 are all disposed on the first surface 421 of the printed circuit board 420. The particular component 440 relative to the power supply components 430 is closer to the opening 320. In an embodiment, the particular component 440 is a heat-dissipating element, e.g., a metal heat pipe or a metal fin. Heat generated by the printed circuit board 420 can be transferred to the heat-dissipating element. Since the heat-dissipating element relative to the power supply components 430 is closer to the opening 320, it is beneficial to heat exchange between the heat-dissipating element and outside cool air, and, consequently, the effect of heat dissipation is well. In an embodiment, the particular component 440 is a driving module. The driving module relative to the power supply components 430 (the electronic components generating less heat than the driving module) is closer to the opening 320, which is beneficial to heat exchange between the driving module and outside cool air. Thus the effect of heat dissipation is well. The driving module comprises one or more electronic components generating significant heat. The electronic component includes an inductor, a transistor, or an integrated circuit. The arrangement that the inductor, the transistor, or the integrated circuit relative to the power supply components 430 is closer to the opening 320 is beneficial to improve the effect of heat dissipation.

Figure 19:
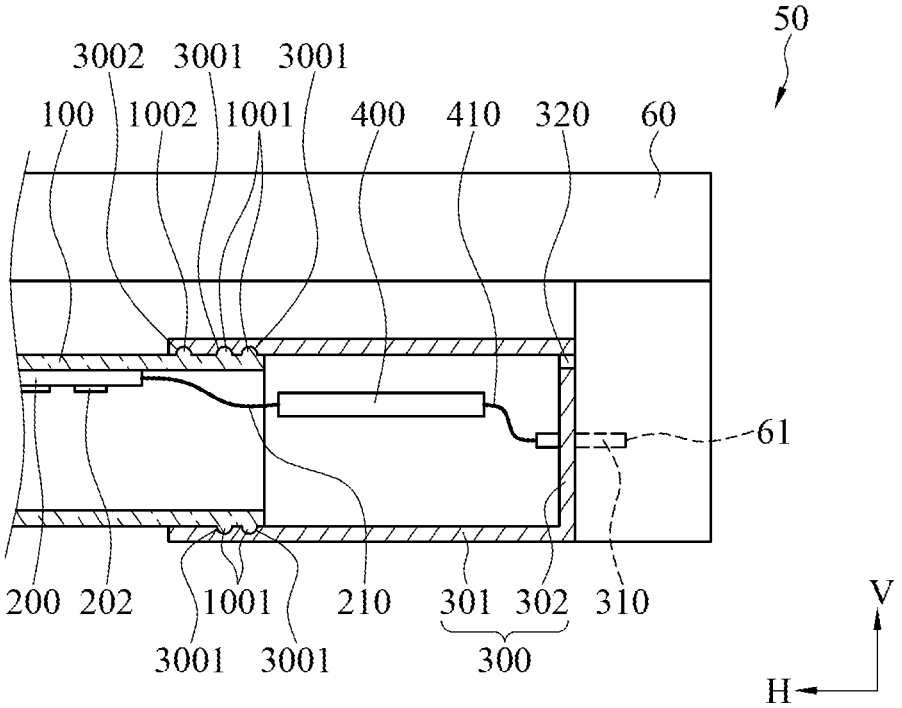
FIGS. 19 and 20 illustrate a part of cross sections of LED tube lamps installed to lamp bases according to several embodiments of the instant disclosure.

Referring to FIG. 19, FIG. 19 is a part of a cross section of the LED tube lamp 50 installed to a lamp base 60. The LED tube lamp 50 shown in FIG. 19 comprises a coupling structure. A part of the coupling structure is disposed on the end of the LED lamp tube 100, and the other part of the coupling structure is disposed on the end cap 300. The LED lamp tube 100 and the end cap 300 can be connected to each other by the coupling structure. The coupling structure comprises a first thread 3001 disposed on the tube wall 301 and a second thread 1001 disposed on the end of the LED lamp tube 100. The first thread 3001 is on the inner surface of the tube wall 301 and is at an end of the tube wall 301 away from the end wall 302. The second thread 1001 is on the outer surface of the end of the LED lamp tube 100 and is close to the hole of the LED lamp tube 100 (the holes are respectively formed by the two opposite ends of the LED lamp tube 100). The first thread 3001 is corresponding to the second thread 1001. The end cap 300 can be connected to the LED lamp tube 100 by relative rotation of the first thread 3001 and the second thread 1001. Based on the coupling structure, the end cap 300 can be easily assembled to the LED lamp tube 100 or disassembled from the LED lamp tube 100.

As shown in FIG. 19, in the embodiment, when the relative rotation of the first thread 3001 and the second thread 1001 is done and the first thread 3001 fully matches the second thread 1001 (i.e., the end cap 300 is properly assembled to the LED lamp tube 100), the opening 320 is rotated about the axle of the LED lamp tube 100 to a predetermined position. Specifically, while the lamp base 60 is horizontal or substantially horizontal and the LED tube lamp 50 is horizontally installed to the lamp base 60, the axial directions of the LED lamp tube 100 and the end cap 300 are parallel with the horizontal direction "H", and the predetermined position means that the altitude of the opening 320 is higher than that of the axle of the tube wall 302 in the vertical direction "V" in the configuration.

As shown in FIG. 19, in the embodiment, the coupling structure further comprises a first positioning unit 3002 disposed on the tube wall 301 and a second positioning unit 1002 disposed on the end of the LED lamp tube 100. The first positioning unit 3002 is corresponding to the second positioning unit 1002. When the relative rotation of the first thread 3001 and the second thread 1001 is done and the first thread 3001 fully matches the second thread 1001, the first positioning unit 3002 mates the second positioning unit 1002, such that the LED lamp tube 100 and the end cap 300 are positioned to each other. In the embodiment, the first positioning unit 3002 is a concave point on the inner surface of the tube wall 301, and the second positioning unit 1002 is a convex point on the outer surface of the end of the LED lamp tube 100. When the first thread 3001 fully matches the second thread 1001, the convex point of the second positioning unit 1002 falls in the concave point of the first positioning unit 3002 to assist the fixation of the LED tube lamp 50 and to inform people assembling the LED tube lamp 50 that the end cap 300 has been properly assembled to the LED lamp tube 100. More particularly, when the first positioning unit 3002 and the second positioning unit 1002 are coupled to each other along with slightly sound and vibration, people assembling the LED tube lamp 50 can be informed by hearing the sound or feeling the vibration and can immediately realize that the end cap 300 has been properly assembled to the LED lamp tube 100. In the assembling process of the LED tube lamp 50, operator, based on the sound and the vibration generated by the mating (coupling) of the first positioning unit 3002 and the second positioning unit 1002, can finish the assembling process of an assembled LED tube lamp 50 in time. Thus the efficiency of assembling can be improved.

In different embodiments, the first positioning unit 3002 can be a convex point, and the second positioning unit 1002 can be a concave point. In different embodiments, the first positioning unit 3002 and the second positioning unit 1002 can respectively be disposed on different positions of the end cap 300 and the end of the LED lamp tube 100 on the premise that the first positioning unit 3002 mates the second positioning unit 1002 only when the end cap 300 is properly assembled to the LED lamp tube 100.

As shown in FIG. 19, the method of having the LED tube lamp 50 installed to the lamp base 60 is: plugging the hollow conductive pins 310 of the end cap 300 into the conductive sockets 61 of the lamp base 60, and rotating the LED tube lamp 50 about the axle of the LED lamp tube 100 and the end cap 300 until the hollow conductive pins 310 in the conductive sockets 61 are rotated to a predetermined position. The assembling is done when the hollow conductive pins 310 in the conductive sockets 61 are in the predetermined position.

In the embodiment, torque applied to the LED lamp tube 100 and the end cap 300 to have the first thread 3001 and the second thread 1001 relatively rotated until the first thread 3001 fully matches the second thread 1001 is greater than that applied to the LED tube lamp 50 to have the LED tube lamp 50 installed to the lamp base 60 (i.e., torque for rotating the hollow conductive pins 310 in the conductive sockets 61). In other words, friction force between the first thread 3001 and the second thread 1001 of the assembled LED tube lamp 50 is greater than that between the hollow conductive pins 310 and the conductive sockets 61 when the LED tube lamp 50 is installed to the lamp base 60. In an embodiment, the friction force between the first thread 3001 and the second thread 1001 is at least twice greater than that between the hollow conductive pins 310 and the conductive sockets 61. When the installed LED tube lamp 50 is going to be uninstalled from the lamp base 60, the hollow conductive pins 310 in the conductive sockets 61 have to be reversely rotated to a predetermined position in advance, and then the LED tube lamp 50 can be unplugged from the lamp base 60 (i.e., the hollow conductive pins 310 can be unplugged from the conductive sockets 61). Since the friction force between the first thread 3001 and the second thread 1001 is greater than that between the hollow conductive pins 310 and the conductive sockets 61, the relative position of the first thread 3001 and the second thread 1001 remains still during the reverse rotation of the hollow conductive pins 310 in the conductive sockets 61. As a result, the end cap 300 won't accidentally loose from the LED lamp tube 100 during the process of uninstalling the LED tube lamp 50 from the lamp base 60.

Figure 20:
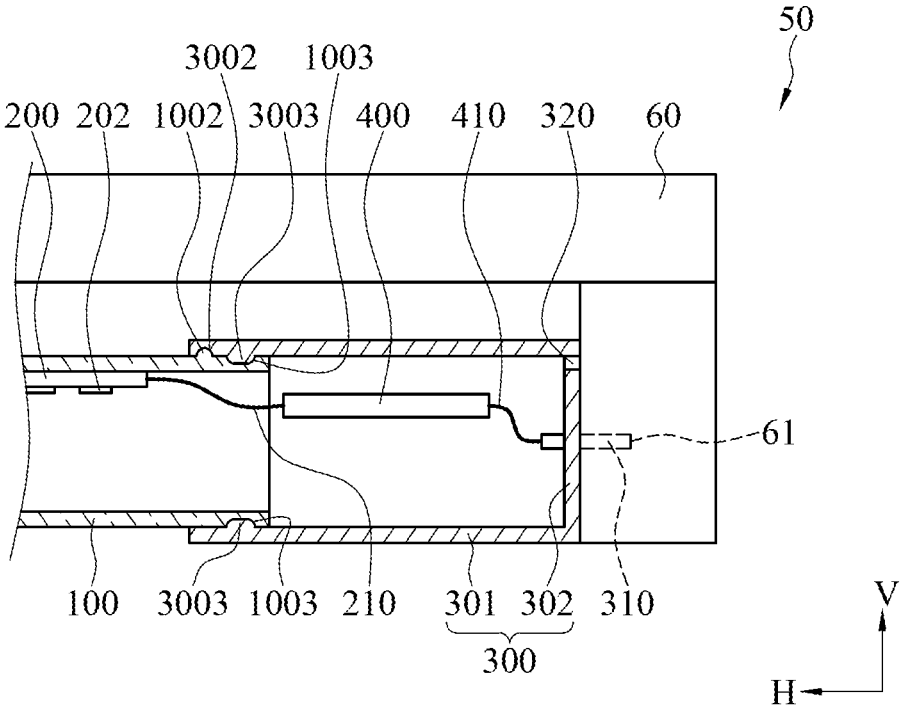

Referring to FIG. 20, FIG. 20 is a part of a cross section of the LED tube lamp 50 installed to the lamp base 60, the difference between the LED tube lamps 50 of the FIG. 20 and FIG. 19 is with respect to the coupling structures. As shown in FIG. 20, the coupling structure comprises an annular convex portion 3003 disposed on the tube wall 301 and an annular trough 1003 disposed on the end of the LED lamp tube 100. The annular convex portion 3003 is on the inner surface of the tube wall 301 and is at an end of the tube wall 301 away from the end wall 302. The annular trough 1003 is on the outer surface of the end of the LED lamp tube 100. The annular convex portion 3003 is corresponding to the annular trough 1003. The end cap 300 can be connected to the LED lamp tube 100 by the coupling of the annular convex portion 3003 and the annular trough 1003. The annular convex portion 3003 and the annular trough 1003 are rotatably connected to each other. More particularly, the annular convex portion 3003 is capable of sliding along the annular trough 1003, and, consequently, the LED lamp tube 100 and the end cap 300 have a degree of freedom capable of rotating relative to each other about the axle of the LED lamp tube 100 and the end cap 300 by the annular convex portion 3003 and the annular trough 1003.

As shown in FIG. 20, in the embodiment, the coupling structure further comprises a first positioning unit 3002 disposed on the tube wall 301 and a second positioning unit 1002 disposed on the end of the LED lamp tube 100. The structure and the function of the first positioning unit 3002 and the second positioning unit 1002 are described above and there is no need to repeat. Although the LED lamp tube 100 and the end cap 300 are rotatably connected to each other by the coupling of the annular convex portion 3003 and the annular trough 1003, the first positioning unit 3002 mates the second positioning unit 1002 (e.g., the concave point of the first positioning unit 3002 and the convex point of the second positioning unit 1002 are coupled to each other) when the LED lamp tube 100 and the end cap 300 are rotated relative to each other to a predetermined position to assist the positioning in the assembling process of the LED lamp tube 100 and the end cap 300 and to enhance the fixation of the LED lamp tube 100 and the end cap 300. Based on the coupling structure, the end cap 300 can be easily assembled to the LED lamp tube 100 or disassembled from the LED lamp tube 100.

As shown in FIG. 19 and FIG. 20, in the embodiment, the diameter of the end cap 300 is greater than that of the LED lamp tube 100. Thus the outer surface of the tube wall 301 of the end cap 300 is not aligned with the outer surface of the LED lamp tube 100 while the end cap 300 and the LED lamp tube 100 are connected to each other. The difference between the outer surface of the tube wall 301 of the end cap 300 and the outer surface of the LED lamp tube 100 is equal to the thickness of the tube wall 301 in the radial direction.

In different embodiments, the annular trough 1003 can be disposed on the tube wall 301, and the annular convex portion 3003 can be disposed on the end of the LED lamp tube 100. Additionally, the coupling structure can further comprise a hot melt adhesive. The hot melt adhesive can be disposed in the joint of the LED lamp tube 100 and the end cap 300 (e.g., between the end of the LED lamp tube 100 and the tube wall 301). When assembling the LED lamp tube 100 and the end cap 300, the end cap 300 can be assembled to the LED lamp tube 100 via the coupling structure in advance, and the hot melt adhesive is in liquid state in the assembling process. After the hot melt adhesive hardens, the end cap 300 can be firmly fixed to the LED lamp tube 100. Under the circumstance, the end cap 300 and the LED lamp tube 100 is hard to disassemble unless the hardened hot melt adhesive returns to liquid state by certain process. The design of the LED tube lamp 50 is to take into account both the convenience regarding the assembling process of the LED tube lamp 50 and the robustness regarding the assembled LED tube lamp 50.

Figure 21:
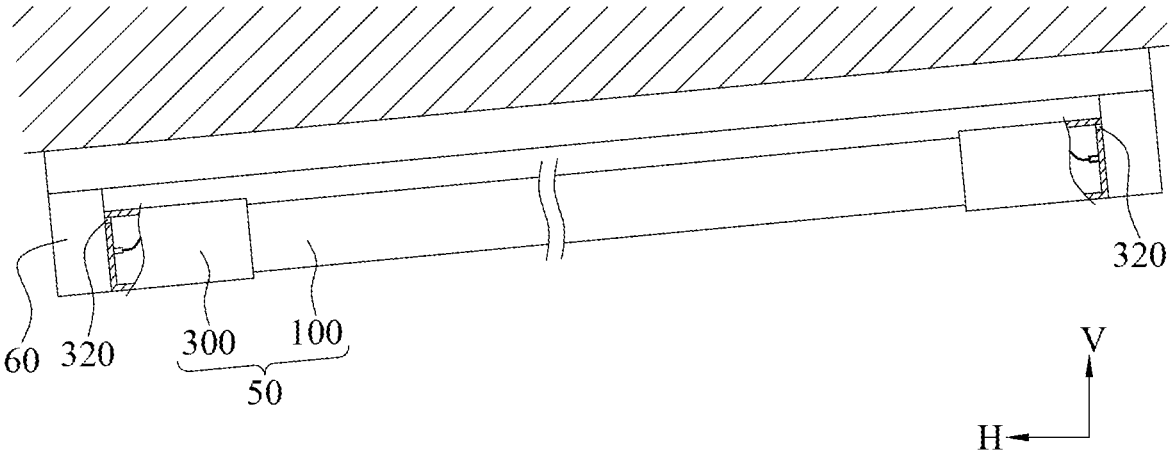
FIG. 21 illustrates a perspective view of an LED tube lamp installed to a lamp base according to an embodiment of the instant disclosure.

Referring to FIG. 21, FIG. 21 is a perspective view of the LED tube lamp 50 installed to an inclined lamp base 60. In different embodiments, the LED tube lamp 50 can be installed to an inclined or a vertical lamp base 60 in an inclined or vertical pose. In the embodiment, as shown in FIG. 21, the lamp base 60 is inclined. Thus the axle of the LED tube lamp 50 and the horizontal direction "H" define an acute angle while the LED tube lamp 50 is installed to the lamp base 60. Under the circumstance that the LED tube lamp 50 installed to the lamp base 60 is inclined, the altitude of the opening 320 of the end cap 300 is still higher than that of the axle of the LED tube lamp 50 in the vertical direction "V", which is beneficial to improve the effect of heat dissipation.

Figure 22:
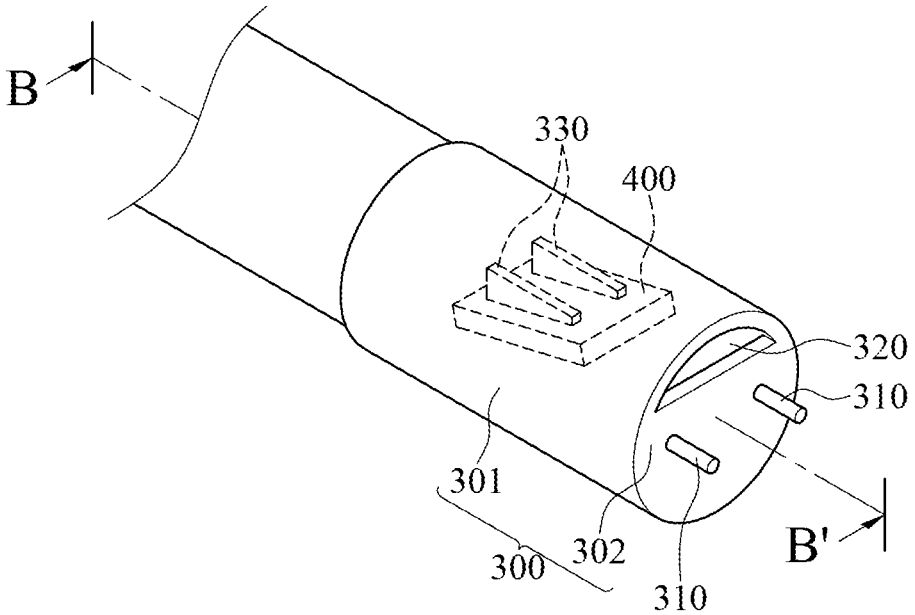
FIG. 22 illustrates a partial view of an LED tube lamp according to an embodiment of the instant disclosure.
Figures 1, 22:
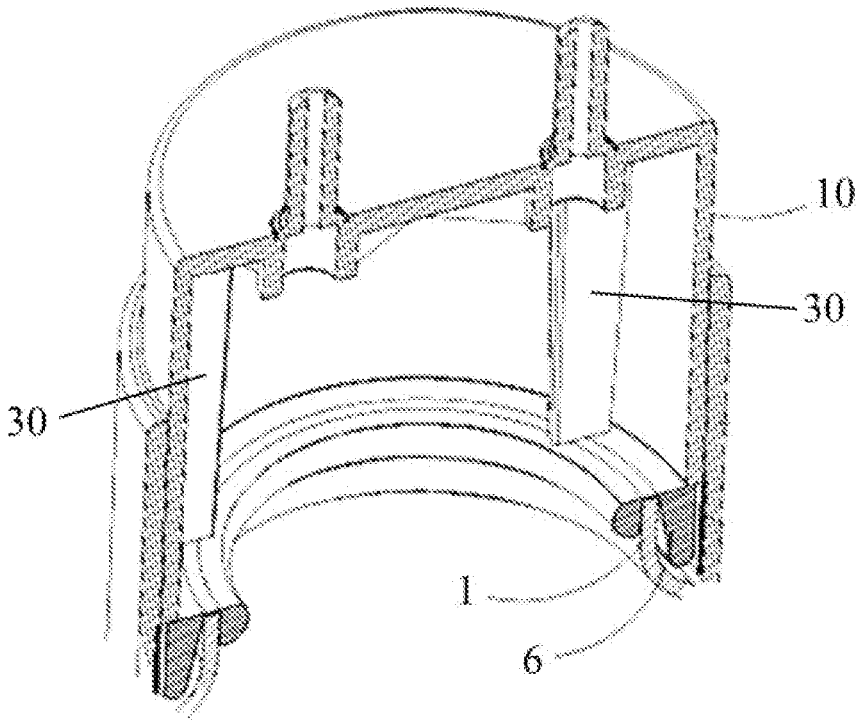
Figure 23:
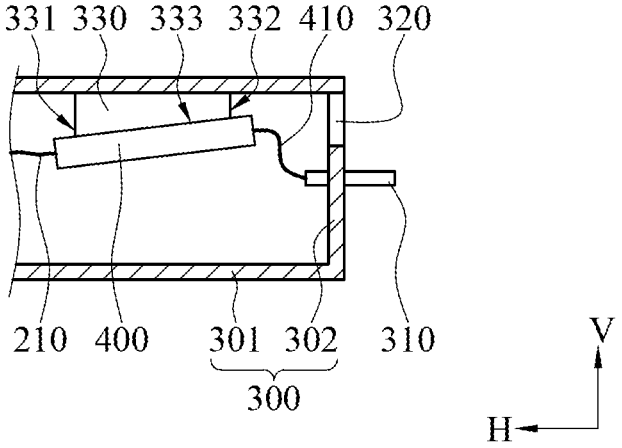
FIG. 23 illustrates a part of a cross section of FIG. 22 along the line B-B'.
Figure 24:
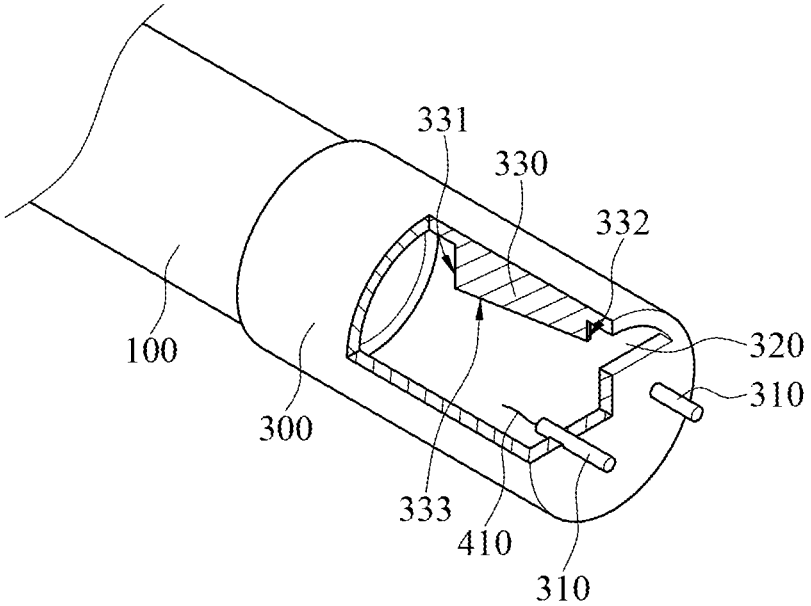
FIG. 24 illustrates a partially steric cross section of FIG. 22.

Referring to FIGS. 22, 23 and 24, FIG. 22 is a partial view of the LED tube lamp 50, FIG. 23 is a cross section of FIG. 22 along the line B-B', and FIG. 24 is a partially cross section of FIG. 22. Wherein a part of components of the end cap 300 is not shown in FIG. 24. The difference between the end cap 300 of FIGS. 22 to 24 and the end cap 300 of FIG. 3 is the forms of the openings 320. Additionally, the end cap 300 of FIGS. 22 to 24 further comprises two vertical ribs 330, and the vertical ribs 330 are utilized for fixation of the power supply 400. Thus the relative position between the power supply 400 and the end cap 300 of FIGS. 22 to 24 can be varied based on the shape of the vertical ribs 300. Referring to FIG. 22-1, FIG. 22-1 is a three dimensional, cross sectional view of an end cap of an LED tube lamp according to an embodiment of the instant disclosure.

As shown in FIG. 22, in the embodiment, the opening 320 has a bow-shaped opening. The size and the position of the opening 320 are corresponding to the two vertical ribs 330. That is to say, the two vertical ribs can be seen from outside the opening 320 in the viewing angle which is parallel with and is along the axial direction of the end cap 300. Furthermore, the two vertical ribs 330 are disposed on the inner surface of the tube wall 301, and the two vertical ribs are spaced from each other and extend along the axial direction of the tube wall 301. The vertical ribs 330 are perpendicular to a plane at which the power supply 400 is located. In other words, the two vertical ribs 330 are perpendicular to a side of the power supply 400 in the radial direction of the end cap 300. For illustration, as shown in FIG. 23, when the LED tube lamp 50 is horizontally installed, the axial directions of the end cap 300 is parallel with the horizontal direction "H", and the vertical ribs 300 extend from the inner surface of the tube wall 301 along the vertical direction "V" and is connected to the power supply 400.

As shown in FIG. 23 and FIG. 24, the vertical rib 330 comprises a first side 331, a second side 332, and a third side 333. The first side 331 and the second side 332 are opposite to each other. The second side 332 relative to the first side 331 is closer to the opening 320. The third side 333 is away from the tube wall 301 and is between the first side 331 and the second side 332. The third side 333 is connected to the power supply 400. The third side 333 is, but is not limited to, adhered to or coupled to the power supply 400.

In the embodiment, as shown in FIGS. 22 to 24, the shortest distance between the third side 333 of the vertical rib 330 and the tube wall 301 gradually decreases along the axial direction of the tube wall 301 towards the end wall 302. For illustration, as shown in FIG. 23, the height of any point of the vertical rib 330 along the horizontal direction "H" relative to the tube wall 301 in the vertical direction "V" is the shortest distance between the third side 333 of the vertical rib 330 and the tube wall 301. The height of the vertical rib 330 gradually decreases along the axial direction of the tube wall 301 towards the end wall 302. That is to say, the height of the vertical rib 330 relative to the tube wall 301 gradually decreases from the first side 331 to the second side 332. Thus an extending direction of the third side 333 and the axial direction of the end cap 300 define an acute angle, and, consequently, the power supply 400 connected to the third side 333 is inclined. For illustration, as shown in FIG. 23, the altitude of one side of the power supply 400 close to the end wall 302 is different from that of the other side of the power supply 400 away from the end wall 302 in the vertical direction "V". The altitude of the side of the power supply 400 close to the end wall 302 is higher than that of the other side of the power supply 400 away from the end wall 302. The side of the power supply 400 close to the end wall 302 relative to the other side of the power supply 400 is closer to the opening 320. Under the circumstance, heated air generated by the power supply 400 can rise along the inclined power supply 400 and flow through the opening 320 to outside area, which is beneficial to improve the effect of heat dissipation.

Figure 25:
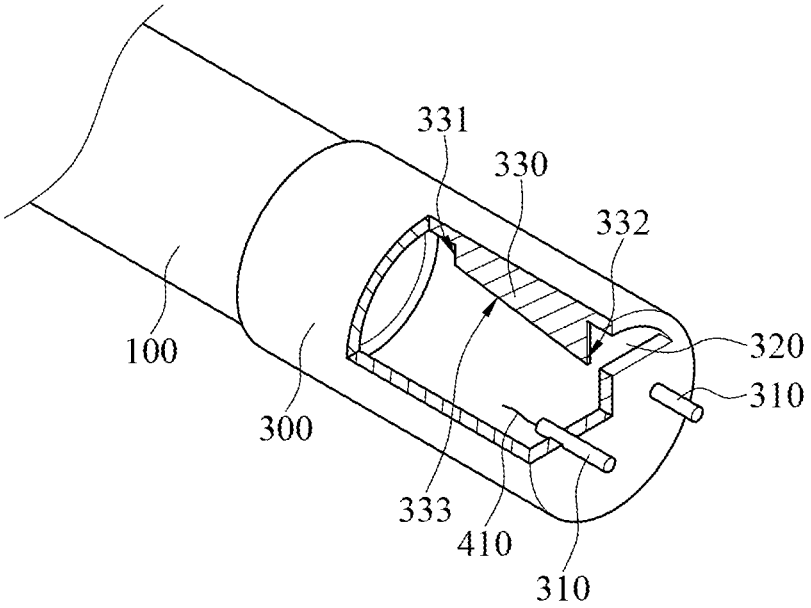
FIG. 25 illustrates a partially steric cross section of an LED tube lamp according to an embodiment of the instant disclosure.

Referring to FIG. 25, the difference between the end cap 300 of FIG. 25 and the end cap 300 of FIGS. 22 to 24 is the forms of the vertical ribs 330. The shortest distance between the third side 333 of the vertical rib 330 shown in FIG. 25 and the tube wall 301 gradually increases along the axial direction of the tube wall 301 towards the end wall 302. That is to say, the height of the vertical rib 330 relative to the tube wall 301 gradually increases from the first side 331 to the second side 332. Under the circumstance, the altitude of one side of the power supply 400 connected to the third side 333 of the vertical rib 330 close to the end wall 302 is lower than that of the other side of the power supply 400 away from the end wall 302. The configuration of the vertical ribs 330 and the power supply 400 shown in FIG. 25 is beneficial to convection of inside heated air and outside cool air since outside cool air can easily enter the inner space of the end cap 300.

Figure 26:
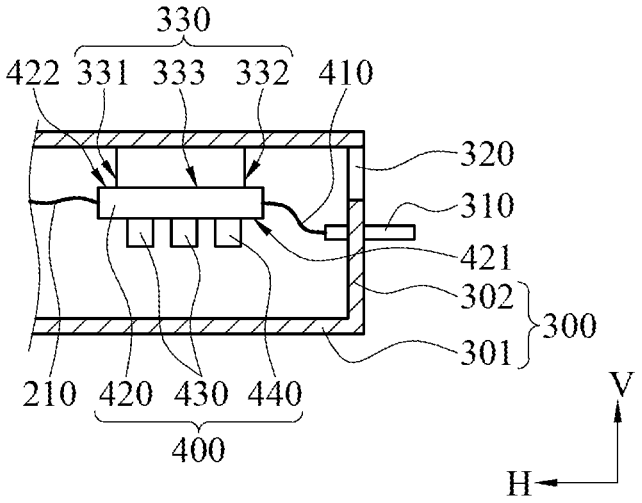
FIG. 26 illustrates a part of a cross section of an LED tube lamp according to an embodiment of the instant disclosure.

Referring to FIG. 26, the difference between the end cap 300 of FIG. 26 and the end cap 300 of FIGS. 22 to 24 is the forms of the vertical ribs 330. In addition, the power supply 400 shown in FIG. 26 further comprises a printed circuit board 420. In different embodiments, the power supply 400 can further comprise a power module disposed on the printed circuit board 420 or can further comprise one or more power supply components 430 and one or more particular components 440 disposed on the printed circuit board 420. In different embodiments, the power supply 400 can be a module, e.g., an integrated power module integrated with the printed circuit board 420 and electronic components.

As shown in FIG. 26, in the embodiment, the power supply 400 further comprises power supply components 430 and a particular component 440 disposed on the printed circuit board 420. Specifically, the printed circuit board 420 comprises a first surface 421 and a second surface 422 opposite to each other. The power supply components 430 and the particular component 440 are disposed on the first surface 421. The second surface 422 is connected to the third sides 333 of the vertical ribs 330. In the embodiment, the height of the vertical rib 330 relative to the tube wall 301 from the first side 331 to the second side 332 is identical, and, consequently, the printed circuit board 420 connected to the third side 333 is horizontal but not inclined. The particular component 440 can be a heat-dissipating element, an inductor, a transistor, or an integrated circuit. The particular component 440 relative to the power supply components 430 is closer to the opening 320. In addition, the second surface 422 of the printed circuit board 420 is spaced from the tube wall 301 by a certain interval based on the vertical ribs 330. An extending direction of the vertical rib 330 from the first side 331 to the second side 332 is towards the opening 320. As a result, there is a space for convection of air between the power supply 400 and the tube wall 301, and heated air can easily flow through the opening 320 to outside area.

Figure 27:
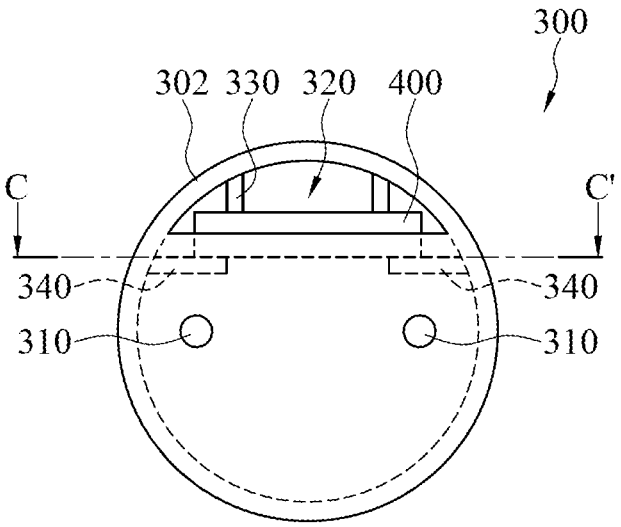
FIG. 27 illustrates an end view of an LED tube lamp in which the viewing angle is parallel with an axle of an end cap according to an embodiment of the instant disclosure.
Figure 28:
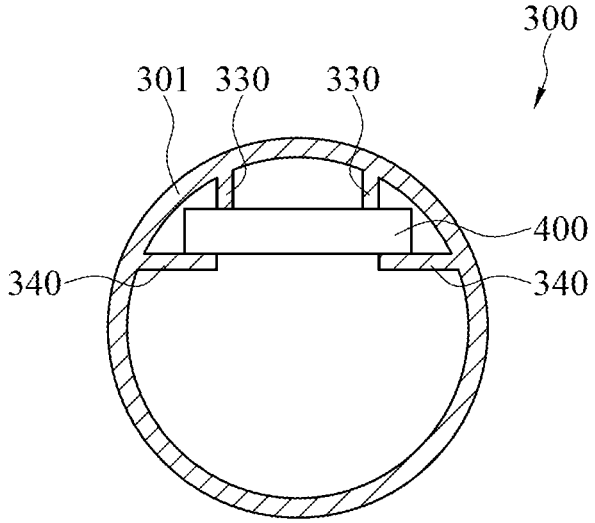
FIG. 28 illustrates a radial cross section of an end cap of FIG. 27.
Figure 29:
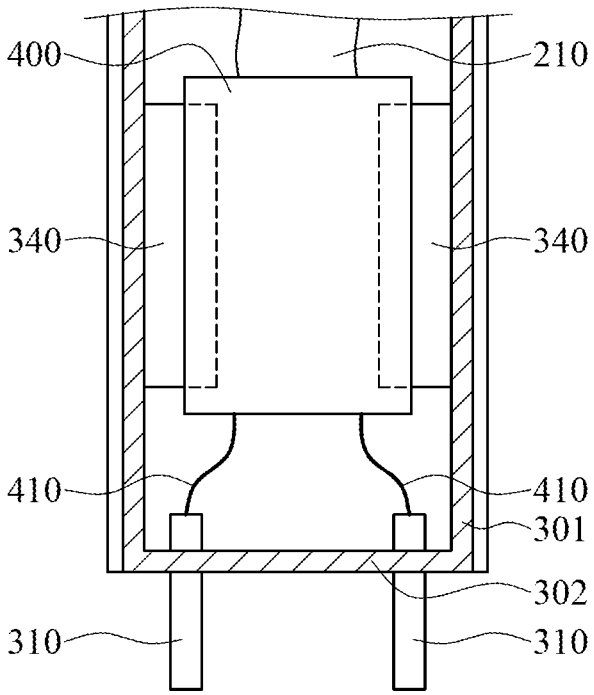
FIG. 29 illustrates a part of an axial cross section of FIG. 27 along the line C-C'.

Referring to FIGS. 27 to 29, FIG. 27 is an end view of the LED tube lamp 50 in which the viewing angle is parallel with the axle of the end cap 300, FIG. 28 is a radial cross section of the end cap 300 of FIG. 27, and FIG. 29 is a part of an axial cross section of FIG. 27 along the line C-C'. The difference between the end caps 300 between FIGS. 27 to 29 and FIG. 26 is that the end cap 300 shown in FIGS. 27 to 29 further comprises two horizontal ribs 340, and the power supply 400 shown in FIGS. 27 to 29 is a power module.

The opening 320 is the bow-shaped opening, as described above. The size and the position of the opening 320 are corresponding to the two vertical ribs 330. More particularly, a projection of the two vertical ribs 330 is inside a projection of the opening 320 on a plane of projection perpendicular to the axial direction of the end cap 300. In other words, as shown in FIG. 27, the two vertical ribs can be seen from outside the opening 320 when seeing into the opening 320 along the axial direction of the end cap 300. As a result, the space for convection between the two vertical ribs 330 and power supply 400 is corresponding to the opening 320 which is beneficial to improve the effect of heat dissipation.

In the embodiment, as shown in FIGS. 27 to 29, the two horizontal ribs 340 are disposed on the inner surface of the tube wall 301, and the two horizontal ribs 340 are spaced from each other and extend along the axial direction of the tube wall 301. Each of the horizontal ribs 340 has a long and flat shape. The two horizontal ribs 340 are opposite to each other and are symmetric. The two horizontal ribs 340 are respectively corresponding to the two vertical ribs 330. The power supply 400 is sandwiched between the vertical ribs 330 and the horizontal ribs 340. In other words, one side of the power supply 400 is connected to the vertical ribs 330, and the other side of the power supply 400 is connected to the horizontal ribs 340. The collaboration of the vertical ribs 330 and the horizontal ribs 340 can firmly clamp and fix the power supply 400.

Figure 30:
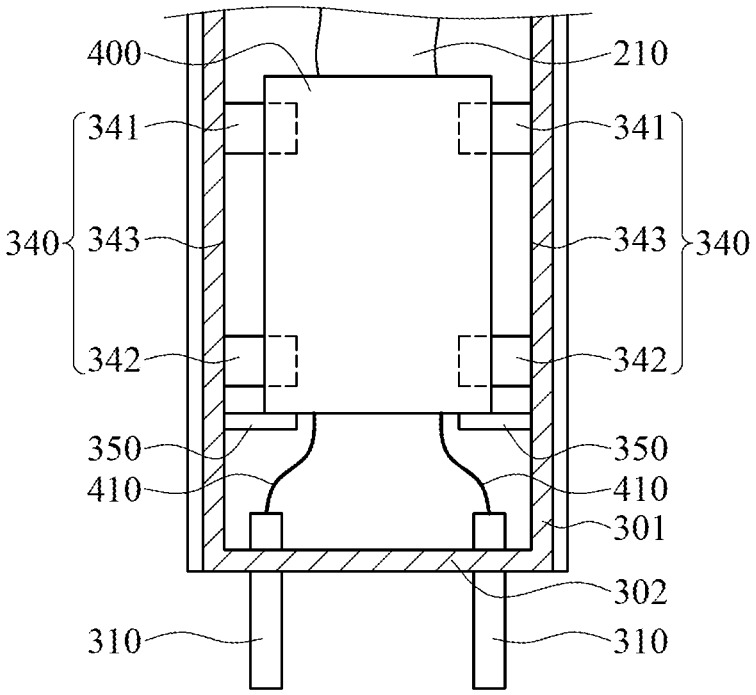
FIGS. 30 and 31 illustrate a part of axial cross sections of LED tube lamps according to several embodiments of the instant disclosure.

Referring to FIG. 30, the difference between the end caps 300 of FIG. 30 and FIG. 29 is that the horizontal rib 340 shown in FIG. 29 is a whole piece and instead, the horizontal rib 340 shown in FIG. 30 has a cut portion. More particularly, the horizontal rib 340 shown in FIG. 30 comprises a first rib portion 341, a second rib portion 342, and a cut portion 343. The cut portion 343 is between the first rib portion 341 and the second rib portion 342. That is to say, the first rib portion 341 and the second rib portion 342 are spaced from each other by the cut portion 343. The cut portion 343 can be utilized for convection of air and is beneficial to improve the effect of heat dissipation.

In addition, the difference between the end caps 300 of FIG. 30 and FIG. 29 is that the end cap 300 shown in FIG. 30 further comprises a blocking plate 350. The blocking plate 350 is disposed on the inner surface of the tube wall 301. The blocking plate 350 and the end wall 302 are spaced from each other in the axial direction of the tube wall 301. A side of the power supply 400 facing towards the end wall 302 contacts the blocking plate 350. The power supply 400 is spaced from the end wall 302 by the blocking plate 350 such that there is a gap between the power supply 400 and the end wall 302 in the axial direction of the tube wall 301. The gap can be utilized for convection of air and is beneficial to improve the effect of heat dissipation.

Figure 31:
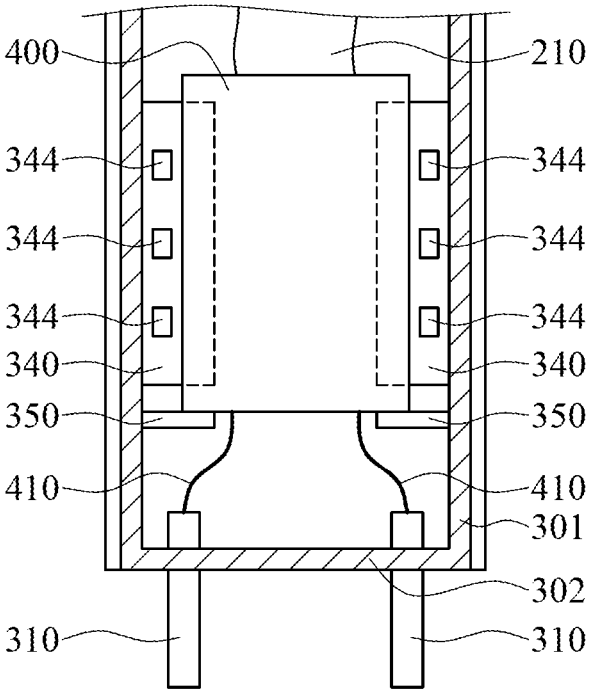

Referring to FIG. 31, the difference between the end caps 300 of FIG. 31 and FIG. 29 is that the horizontal rib 340 shown in FIG. 29 is a whole piece and instead, the horizontal rib 340 shown in FIG. 31 comprises one or more through holes. More particularly, each of the horizontal ribs 340 shown in FIG. 31 comprises a plurality of ventilating holes 344. The ventilating hole 344 penetrates through the horizontal rib 340 and the ventilating holes 344 are arranged on the horizontal rib 340. The ventilating holes 344 can be utilized for convection of air and is beneficial to improve the effect of heat dissipation.

Figure 32:
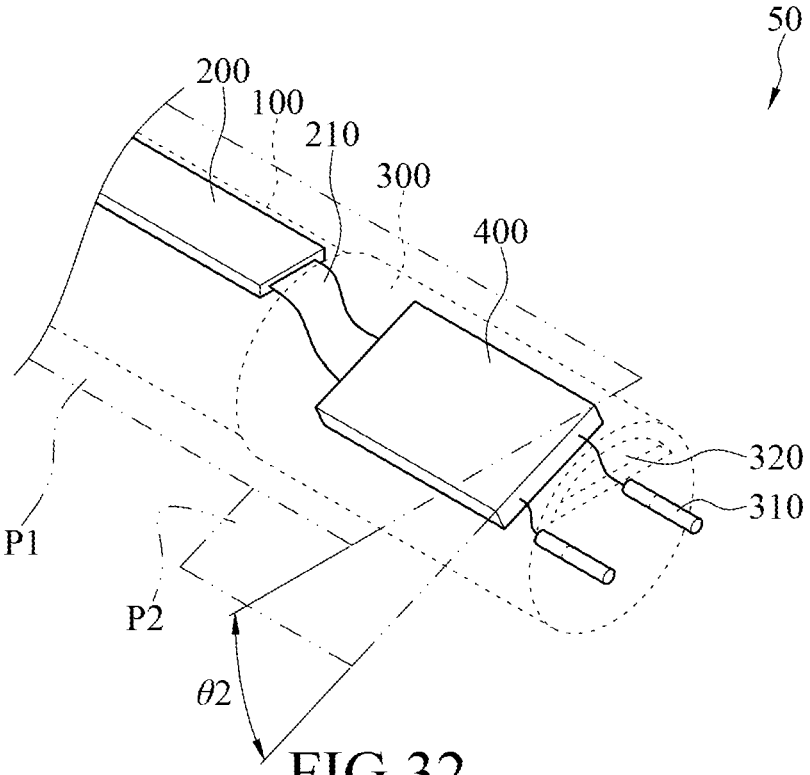
FIG. 32 illustrates a partial view of an LED tube lamp according to an embodiment of the instant disclosure, and some components thereof are transparent.

Referring to FIG. 32, the difference between the LED tube lamps 50 of FIG. 32 and FIGS. 1 to 4 is with respect to the relationship of the LED light strip 200 and the power supply 400. A plane at which the LED light strip 200 shown in FIGS. 1 to 4 locates is parallel with a plane at which the power supply 400 locates. However, a plane at which the LED light strip 200 shown in FIG. 32 locates is not parallel with a plane at which the power supply 400 locates. More particularly, as shown in FIG. 32, the LED light strip 200 locates at a first plane P1, and the power supply 400 locates at a second plane P2. The first plane P1 and the second plane P2 are parallel with the axial direction of the LED lamp tube 100, and the first plane P1 and the second plane P2 define an angle θ2 about the axial direction of the LED lamp tube 100. The angle θ2 is greater than 0 degree and is less than 90 degrees. In other words, comparing to the power supply 400 and the LED light strip 200 shown in FIGS. 1 to 4, the power supply 400 shown in FIG. 32 relative to the LED light strip 200 rotates about the axial direction of the LED lamp tube 100 to the angle θ2. Based on the configuration that the plane at which the LED light strip 200 locates and the plane at which the power supply 400 locates are not parallel with each other and instead intersect on a plane of projection along the axial direction of the LED lamp tube 100, the heated air heated by the LED light strip 200 and the LED light sources 202 can easily flow through the LED lamp tube 100 to the end cap 300 so as to further flow through the opening 320 to outside area, which is beneficial to improve the effect of heat dissipation.

Figure 33:
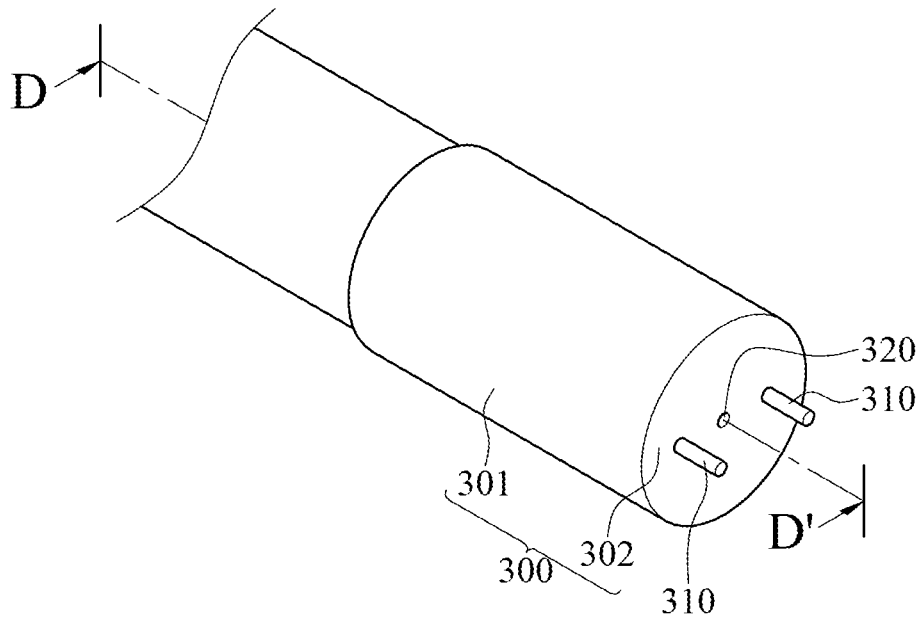
FIG. 33 illustrates a partial view of an LED tube lamp according to an embodiment of the instant disclosure.

Referring to FIG. 33, the difference between the end caps 300 of FIG. 33 and FIGS. 1 to 4 is the forms of the openings 320. The opening 320 shown in FIG. 33 is, but is not limited to, at the center of the end wall 302. In the assembling process of the LED tube lamp 50, two end caps 300 have to be assembled to two ends of the LED lamp tube 100. After one of the two end caps 300 is assembled to one end of the LED lamp tube 100, it is more difficult to have the other end caps 300 assembled to the other end of the LED lamp tube 100. The reason is that if the inner space of the LED lamp tube 100 and end caps 300 is sealed or is almost sealed, the pressure inside the LED lamp tube 100 and end caps 300 increases along with compression of gas inside the LED lamp tube 100 and end caps 300. More strength is required to assemble the end cap 300 to the LED lamp tube 100 to against the increased pressure inside the LED lamp tube 100 and end caps 300, which leads to difficulty of assembling. The opening 320 shown in FIG. 33 can function as a pressure-relieving tunnel. Under the circumstance, gas inside the LED lamp tube 100 and end caps 300 can be relieved through the opening 320 during the process of assembling the last one of the two end caps 300 to the LED lamp tube 100, such that the pressure inside the LED lamp tube 100 and end caps 300 can be constant. It is beneficial to the assembling process of the LED tube lamp 50 and to improve the efficiency of assembling.

In addition, when the LED tube lamp 50 operates, the electronic components of the LED tube lamp 50 keep generating heat such that the temperature inside the he LED tube lamp 50 increases. According to the equation of state of a hypothetical ideal gas, the volume of gas inside the LED tube lamp 50 increases along with the increase of the temperature. If gas is sealed in the LED lamp tube 100 and the end caps 300, the volume of the gas is constant. Thus the pressure increases along with the increase of the temperature. Under the circumstance, when the LED tube lamp 50 continuously operates, the electronic components continuously suffer high temperature and high pressure and, consequently, are easily damaged. The opening 320 shown in FIG. 33 can function as a pressure-relieving tunnel. In other words, the expanding gas can be released from the opening 320 when the temperature of the gas inside the LED tube lamp 50 increases, which is beneficial to decrease the pressure inside the LED tube lamp 50.

Figure 34:
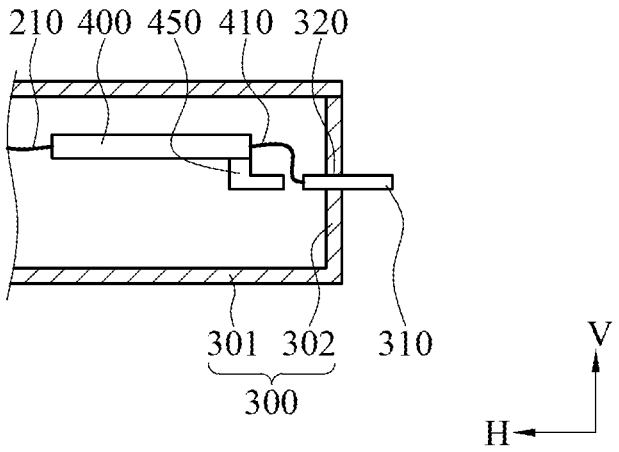
FIG. 34 illustrates a part of a cross section of FIG. 33 along the line D-D', and a light sensor is added.
Figure 35:
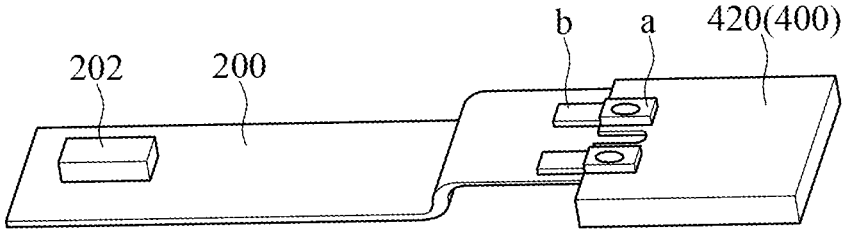
FIG. 35 illustrates a partial view of a LED light strip and a power supply soldered to each other according to an embodiment of the instant disclosure.

Referring to FIG. 34, FIG. 34 is a part of a cross section of FIG. 33 along the line D-D'. The difference between FIG. 34 and FIG. 33 is that the LED tube lamp 50 shown in FIG. 34 further comprises a light sensor 450 and a circuit safety switch (not shown). In the embodiment, the light sensor 450 and the circuit safety switch are, but are not limited to, disposed on the power supply 400 and are electrically connected to the power supply 400. Moreover, the power supply 400 can comprise a built-in electricity source. For example, the power supply 400 can comprise a mini battery; therefore, the power supply 400 can be supplied by the mini battery so as to supply the operation of the light sensor 450 and the circuit safety switch before the LED tube lamp 50 is installed to a lamp base. The circuit safety switch is integrated in the power supply 400. The light sensor 450 is positioned corresponding to the opening 320, and the light sensor 450 is aligned with the opening 320. In different embodiments, the light sensor 450 does not extend into the opening 320. Alternatively, the light sensor 450 can extend into the opening 320. The light sensor 450 can sense light inside the opening 320 or ambient light outside the opening 320 but near the end wall 302. Furthermore, the light sensor 450 can generate sensing signals according to the intensity of the sensed light (e.g., brightness). The sensing signals are transmitted to the circuit safety switch. The circuit safety switch determines whether to close or to open the circuit of the power supply 400 based on the received sensing signals.

How the light sensor 450 and the circuit safety switch work are described below and the description is merely an example but not a limitation. When the brightness sensed by either one of the light sensors 450 of the end caps 300 is greater than a predetermined threshold, the circuit safety switch opens the circuit of the power supply 400. When the brightness sensed by both of the light sensors 450 of the end caps 300 are less than the predetermined threshold, the circuit safety switch closes the circuit of the power supply 400.

For instance, when a user holds the LED tube lamp 50 and is going to install the LED tube lamp 50 to the lamp base 60 (referring to FIGS. 19 to 21), the end caps 300 at two ends of the LED tube lamp 50 are exposed to the environment and do not obstructed by anything such that the brightness sensed by both of the light sensors 450 of the end caps 300 are greater than the predetermined threshold, the circuit safety switch opens the circuit of the power supply 400. Next, when the user has the hollow conductive pins 310 of the end cap 300 of one end of the LED tube lamp 50 plugged into the conductive sockets 61 of one end of the lamp base 60, the light sensor 450 in the end cap 300 having been plugged into one end of the lamp base 60 is obstructed by the lamp base 60, and, consequently, brightness sensed by the light sensor 450 is less than the predetermined threshold. However, brightness sensed by the light sensor 450 in the other end cap 300 which is not yet plugged into the conductive sockets 61 is still greater than the predetermined threshold. In the situation, the circuit safety switch still has the circuit of the power supply 400 remain open. Thus there is no risk of electric shock to the user. Finally, when the user properly install the LED tube lamp 50 to the lamp base 60, both of the end caps 300 at two ends of the LED tube lamp 50 are obstructed by the lamp base 60, and brightness sensed by both of the light sensors 450 of the two end caps 300 are less than the predetermined threshold. Under the circumstance that brightness sensed by both of the light sensors 450 of the two end caps 300 are less than the predetermined threshold, the circuit safety switch closes the circuit of the power supply 400, and the power supply 400 of which the circuit is closed can received electricity from the lamp base 60 and can supply the LED light strip 200 and the LED light source 202.

According to the light sensors 450 and the circuit safety switches of the LED tube lamp 50 shown in FIG. 34, under the circumstance that the hollow conductive pins 310 of the end cap 300 of one end of the LED tube lamp 50 is plugged into the conductive sockets 61 of one end of the lamp base 60 and the hollow conductive pins 310 of the end cap 300 of the other end of the LED tube lamp 50 is still exposed to environment, the circuit safety switches automatically open the circuits of the power supplies 400 (or have the circuits of the power supplies 400 remain open). Thus the user has no risk of electric shock even if the exposed hollow conductive pins 310 are contacted by the user. As a result, safety regarding the use of the LED tube lamp 50 can be ensured.

Figure 36:
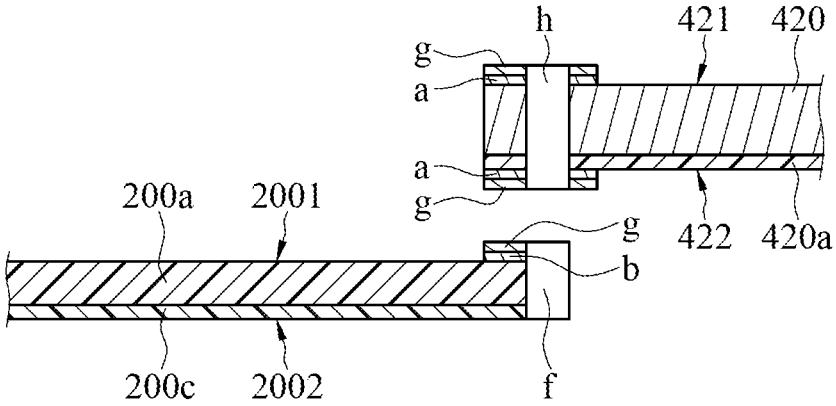
FIGS. 36 to 38 illustrate diagrams of a soldering process of the LED light strip and the power supply according to an embodiment of the instant disclosure.
Figure 37:
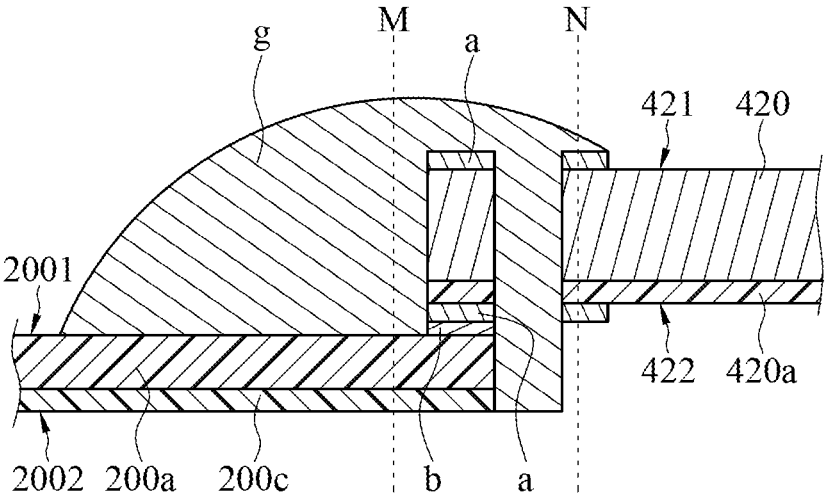
Figure 38:
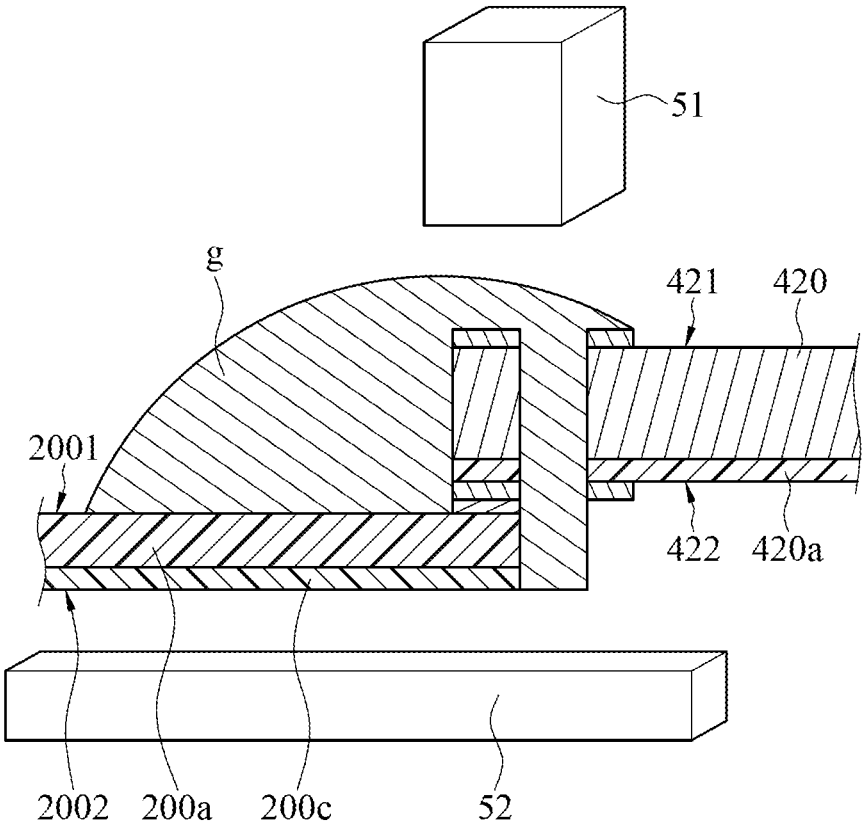

Referring to FIG. 35 to FIG. 38, FIG. 35 is a perspective view of a LED light strip 200, e.g., a bendable circuit sheet, and a printed circuit board 420 of a power supply 400 soldered to each other and FIG. 36 to FIG. 38 are diagrams of a soldering process of the LED light strip 200 and the printed circuit board 420 of the power supply 400. In the embodiment, the LED light strip 200 and the freely extending end portions 210 have the same structure. The freely extending end portions 210 are the portions of two opposite ends of the LED light strip 200 and are utilized for being connected to the printed circuit board 420. The LED light strip 200 and the power supply 400 are electrically connected to each other by soldering. Two opposite ends of the LED light strip 200 are utilized for being respectively soldered to the printed circuit board 420 of the power supplies 400. In other embodiments, only one end of the LED light strip 200 is soldered to the power supply 400. The LED light strip 200 is, but is not limited to, a bendable circuit sheet, and the LED light strip 200 comprises a circuit layer **200*a* and a circuit protecting layer 200*c* over a side of the circuit layer 200*a*. Moreover, the LED light strip 200 comprises two opposite surfaces which are a first surface 2001 and a second surface 2002. The first surface 2001 is the one on the circuit layer 200*a* and away from the circuit protecting layer 200*c*. The second surface 2002 is the other one on the circuit protecting layer 200*c* and away from the circuit layer 200*a*. Several LED light sources 202 are disposed on the first surface 2001 and are electrically connected to circuits of the circuit layer 200*a*. The circuit protecting layer 200*c* is made by polyimide (PI) having less conductivity but being beneficial to protect the circuits. The first surface 2001 of the LED light strip 200 comprises soldering pads "b". Soldering material "g" can be placed on the soldering pads "b". In the embodiment, the LED light strip 200 further comprises a notch "f". The notch "f" is disposed on an edge of the end of the LED light strip 200 soldered to the printed circuit board 420 of the power supply 400. The printed circuit board 420 comprises a power circuit layer 420*a* and soldering pads "a". Moreover, the printed circuit board 420 comprises two opposite surfaces which are a first surface 421 and a second surface 422. The second surface 422 is the one on the power circuit layer 420*a*. The soldering pads "a" are respectively disposed on the first surface 421 and the second surface 422. The soldering pads "a" on the first surface 421 are corresponding to those on the second surface 422. Soldering material "g" can be placed on the soldering pad "a". In the embodiment, considering the stability of soldering and the optimization of automatic process, the LED light strip 200 is disposed below the printed circuit board 420 (the direction is referred to FIG. 36). That is to say, the first surface 2001 of the LED light strip 200 is connected to the second surface 422 of the printed circuit board 420**.

As shown in FIG. 37 and FIG. 38, in the soldering process of the LED light strip 200 and the printed circuit board 420, the circuit protecting layer 200*c* of the LED light strip 200 is placed on a supporting table 52 (i.e., the second surface 2002 of the LED light strip 200 contacts the supporting table 52) in advance. The soldering pads "a" on the second surface 422 of the printed circuit board 420 directly sufficiently contact the soldering pads "b" on the first surface 2001 of the LED light strip 200. And then a thermo-compression heating head 51 presses on a portion where the LED light strip 200 and the printed circuit board 420 are soldered to each other. When soldering, the soldering pads "b" on the first surface 2001 of the LED light strip 200 contact the soldering pads "a" on the second surface 422 of the printed circuit board 420, and the soldering pads "a" on the first surface 421 of the printed circuit board 420 contact the thermo-compression heating head 51. Under the circumstance, the heat from the soldering heating heads 51 can directly transmit through the soldering pads "a" on the first surface 421 of the printed circuit board 420 and the soldering pads "a" on the second surface 422 of the printed circuit board 420 to the soldering pads "b" on the first surface 2001 of the LED light strip 200. The transmission of the heat between the thermos-compression heating heads 51 and the soldering pads "a" and b won't be affected by the circuit protecting layer 200*c* which has relatively less conductivity, and, consequently, the efficiency and stability regarding the connections and soldering process of the soldering pads "a" and "b" of the printed circuit board 420 and the LED light strip 200 can be improved. As shown in FIG. 37, the printed circuit board 420 and the LED light strip 200 are firmly connected to each other by the soldering material "g". Components between the virtual line M and the virtual line N of FIG. 37 from top to bottom are the soldering pads "a" on the first surface 421 of printed circuit board 420, the power circuit layer 420*a*, the soldering pads "a" on the second surface 422 of printed circuit board 420, the soldering pads "b" on the first surface 2001 of LED light strip 200, the circuit layer 200*a* of the LED light strip 200, and the circuit protecting layer 200*c* of the LED light strip 200. The connection of the printed circuit board 420 and the LED light strip 200 are firm and stable.

In other embodiments, an additional circuit protecting layer (e.g., PI layer) can be disposed over the first surface 2001 of the circuit layer 200*a*. In other words, the circuit layer 200*a* is sandwiched between two circuit protecting layers, and therefore the first surface 2001 of the circuit layer 200*a* can be protected by the circuit protecting layer. A part of the circuit layer 200*a* (the part having the soldering pads "b") is exposed for being connected to the soldering pads "a" of the printed circuit board 420. Under the circumstance, a part of the bottom of the LED light source 202 contacts the circuit protecting layer on the first surface 2001 of the circuit layer 200*a*, and the other part of the bottom of the LED light source 202 contacts the circuit layer 200*a*.

In addition, according to the embodiment shown in FIG. 35 to FIG. 38, the printed circuit board 420 further comprises through holes "h" passing through the soldering pads "a". In an automatic soldering process, when the thermo-compression heating head 51 automatically presses the printed circuit board 420, the soldering material "g" on the soldering pads "a" can be pushed into the through holes "h" by the thermo-compression heating head 51 accordingly, which fits the needs of automatic process.

While the instant disclosure related to an LED tube lamp has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An LED tube lamp, comprising:

an LED lamp tube, comprising:

a main body; and two rear end regions respectively at two ends of the main body;

two end caps respectively sleeving the two rear end regions an LED light strip, at least a portion of the LED light strip attached to the inner circumferential surface of the LED lamp tube, the LED light strip being provided with a plurality of LED light sources disposed thereon; and a power supply comprising a circuit board electrically connecting the LED light strip and configured to drive the plurality of LED light sources;

wherein the end cap comprises:

a tube wall substantially coaxial with the LED lamp tube and connected to the end of the LED lamp tube;

an end wall substantially perpendicular to an axial direction of the tube wall and connected to an end of the tube wall away from the LED lamp tube; and two vertical ribs on an inner surface of the tube wall, the two vertical ribs being spaced from each other and extending along the axial direction of the tube wall;

wherein each of the vertical ribs comprises a first side, a second side, and a third side, the first side and the second side are opposite to each other, the second side is closer to the end wall relative to the first side, the third side is away from the tube wall and is between the first side and the second side;

further wherein the LED light strip comprises a free extending end portion at one end thereof, the free extending end portion being detached from the inner circumferential surface of the LED lamp tube and electrically connecting to the circuit board, wherein the free extending end portion is directly soldered to the circuit board; and wherein at least a portion of the bottom surface of the LED light strip is attached on the inner circumferential surface of the LED lamp tube and the plurality of LED light sources are mounted on the top surface of the LED light strip, and further wherein the LED light strip comprises two first soldering pads arranged on the free extending end portion and on the top surface of the LED light strip.

2. The LED tube lamp of claim 1, wherein the circuit board comprises two second soldering pads arrange on the top surface thereof, and each of the first soldering pads be soldered with a respective second soldering pad.

3. The LED tube lamp of claim 2, wherein a soldering material covers one of the first soldering pad, the corresponding second soldering pad and an end edge of the free extending end portion.

4. The LED tube lamp of claim 1, further comprising a coupling structure, wherein the at least one end cap is connected to the end of the LED lamp tube by the coupling structure.

5. The LED tube lamp of claim 4, wherein the coupling structure comprises a first thread and a second thread, the first thread is disposed on the tube wall, the second thread is disposed on the end of the LED lamp tube, and the end cap is connected to the LED lamp tube by the matching of the first thread to the second thread.

6. The LED tube lamp of claim 5, wherein the end cap further comprises at least one opening penetrating through the end wall, wherein when the first thread fully matches the second thread, the at least one opening is rotated about the axle of the LED lamp tube to a predetermined position, wherein when the LED tube lamp is horizontally installed to a lamp base, an altitude of the at least one opening is higher than that of the axle of the tube wall in a vertical direction.

7. The LED tube lamp of claim 5, wherein the coupling structure further comprises a first positioning unit and a second positioning unit, the first positioning unit is disposed on the tube wall, the second positioning unit is disposed on the end of the LED lamp tube, and the first positioning unit is corresponding to the second positioning unit, wherein when the first thread fully matches the second thread, the first positioning unit mates the second positioning unit such that the LED lamp tube and the end cap are positioned to each other.

8. The LED tube lamp of claim 7, wherein the first positioning unit is a convex point and the second positioning unit is a concave point; or the first positioning unit is a concave point and the second positioning unit is a convex point.

9. The LED tube lamp of claim 5, wherein torque applied to have the first thread fully match the second thread is greater than that applied to have the LED tube lamp installed to a lamp base.

10. The LED tube lamp of claim 1, wherein the end cap further comprises at least one opening penetrating through the end wall.

11. The LED tube lamp of claim 10, wherein an axial direction of the at least one opening is substantially parallel with the axial direction of the tube wall, and the at least one opening is aligned with an inner surface of the tube wall.

12. The LED tube lamp of claim 10, wherein an axial direction of the at least one opening and the axial direction of the tube wall define an acute angle.

13. The LED tube lamp of claim 1, wherein the end cap further comprises at least one opening penetrating through the end wall, a projection of the two vertical ribs is inside a projection of the at least one opening on a plane of projection perpendicular to the axial direction of the tube wall.

14. The LED tube lamp of claim 1, wherein the end cap further comprises two horizontal ribs, the two horizontal ribs are on the surface of the tube wall, the two horizontal ribs are spaced from each other and extend along the axial direction of the tube wall, the two horizontal ribs are respectively corresponding to the two vertical ribs, and the power supply is between the vertical ribs and the horizontal ribs.

15. The LED tube lamp of claim 14, wherein the horizontal rib comprises a first rib portion, a second rib portion, and a cut portion, the cut portion is between the first rib portion and the second rib portion, and the first rib portion and the second rib portion are spaced from each other by the cut portion.

16. The LED tube lamp of claim 14, wherein the horizontal rib comprises at least one ventilating hole.

17. The LED tube lamp of claim 1, wherein the end cap further comprises a blocking plate, the blocking plate is on the surface of the tube wall, the blocking plate and the end wall are spaced from each other in the axial direction of the tube wall, and a side of the power supply facing towards the end wall contacts the blocking plate.

18. The LED tube lamp of claim 1, wherein the LED light strip locates at a first plane, the power supply locates at a second plane, the first plane and the second plane are parallel with the axial direction of the tube wall, the first plane and the second plane define an angle about the axial direction of the tube wall, and the angle is greater than 0 degree and is less than 90 degrees.

19. The LED tube lamp of claim 1, wherein the two vertical ribs are parallel with each other.

20. The LED tube lamp of claim 1, wherein the two vertical ribs form a channel.

21. The LED tube lamp of claim 20, wherein the channel is good for air circulation.

22. The LED tube lamp of claim 21, wherein the channel communicates the air inside and outside of the end cap.

23. The LED tube lamp of claim 4, wherein the coupling structure comprises an annular convex portion and an annular trough, wherein the annular convex portion is disposed on the tube wall, and the annular trough is disposed on the end of the LED lamp tube; or the annular convex portion is disposed on the end of the LED lamp tube, and the annular trough is disposed on the tube wall, wherein the annular convex portion is corresponding to the annular trough, wherein the coupling structure further comprises a first positioning unit and a second positioning unit, the first positioning unit is disposed on the tube wall, the second positioning unit is disposed on the end of the LED lamp tube, and the first positioning unit is corresponding to the second positioning unit, wherein the end cap is connected to the LED lamp tube by the coupling of the annular convex portion and the annular trough, and the first positioning unit mates the second positioning unit such that the LED lamp tube and the end cap are positioned to each other.

24. An LED tube lamp, comprising:

an LED lamp tube;

at least one end cap connected to an end of the LED lamp tube;

at least one power supply in the end cap; and an LED light strip in the LED lamp tube, the LED light strip being provided with a plurality of LED light sources disposed thereon, the LED light sources being electrically connected to the power supply via the LED light strip;

wherein the end cap comprises:

a tube wall substantially coaxial with the LED lamp tube and connected to the end of the LED lamp tube;

an end wall substantially perpendicular to an axial direction of the tube wall and connected to an end of the tube wall away from the LED lamp tube;

at least one opening penetrating through the end wall; and two vertical ribs on an inner surface of the tube wall, the two vertical ribs being spaced from each other and extending along the axial direction of the tube wall;

wherein the vertical rib comprises a first side, a second side, and a third side, the first side and the second side are opposite to each other, the second side is closer to the at least one opening relative to the first side, the third side is away from the tube wall and is between the first side and the second side, and the third side is connected to the power supply;

wherein the shortest distance between the third side of the vertical rib and the tube wall gradually increases along the axial direction of the tube wall towards the end wall.

25. An LED tube lamp, comprising:

an LED lamp tube;

at least one end cap connected to an end of the LED lamp tube;

at least one power supply in the end cap; and an LED light strip in the LED lamp tube, the LED light strip being provided with a plurality of LED light sources disposed thereon, the LED light sources being electrically connected to the power supply via the LED light strip;

wherein the end cap comprises:

a tube wall substantially coaxial with the LED lamp tube and connected to the end of the LED lamp tube;

an end wall substantially perpendicular to an axial direction of the tube wall and connected to an end of the tube wall away from the LED lamp tube;

at least one opening penetrating through the end wall; and two vertical ribs on an inner surface of the tube wall, the two vertical ribs being spaced from each other and extending along the axial direction of the tube wall;

wherein the vertical rib comprises a first side, a second side, and a third side, the first side and the second side are opposite to each other, the second side is closer to the at least one opening relative to the first side, the third side is away from the tube wall and is between the first side and the second side, and the third side is connected to the power supply;

the shortest distance between the third side of the vertical rib and the tube wall gradually decreases along the axial direction of the tube wall towards the end wall.

* * * * *